US007051964B2

(12) United States Patent
Van Der Zanden

(10) Patent No.: US 7,051,964 B2
(45) Date of Patent: May 30, 2006

(54) STRENGTHENING PLATE AND METHOD FOR THE USE THEREOF

(75) Inventor: Johannes Petrus Andreas Josephus Van Der Zanden, Ring of Kerry, Dunkilla Tahilla Co., Kerry (IE)

(73) Assignees: Rosemarie Johanna Van Der Zanden, Kerry (IE); Johannes Petrus Andreas Josephus Van Der Zanden, Kerry (IE)

( * ) Notice: Subject to any disclaimer, the term of this patent is extended or adjusted under 35 U.S.C. 154(b) by 171 days.

(21) Appl. No.: 10/745,635

(22) Filed: Dec. 29, 2003

(65) Prior Publication Data

US 2004/0250418 A1 Dec. 16, 2004

Related U.S. Application Data

(63) Continuation of application No. PCT/NL02/00425, filed on Jun. 26, 2002.

(30) Foreign Application Priority Data

Jun. 26, 2001 (NL) ..... 1018383
Nov. 5, 2001 (NL) ..... 1019297

(51) Int. Cl.
*B02C 19/00* (2006.01)

(52) U.S. Cl. ..... 241/275

(58) Field of Classification Search ..... 241/275
See application file for complete search history.

(56) References Cited

U.S. PATENT DOCUMENTS

| | | | |
|---|---|---|---|
| 3,204,882 | A | 9/1965 | Vifian et al. |
| 3,346,203 | A | 10/1967 | Danyluke |
| 3,767,127 | A | 10/1973 | Wood |
| 5,037,035 | A | 8/1991 | Garland |
| 6,033,791 | A | 3/2000 | Smith et al. |

FOREIGN PATENT DOCUMENTS

| | | |
|---|---|---|
| DE | 195 28 512 | 2/1997 |
| EP | 0 562 194 | 9/1993 |
| EP | 1 084 751 | 3/2001 |
| WO | WO 84/04760 | 12/1984 |
| WO | WO 99/47264 | 9/1999 |

*Primary Examiner*—Mark Rosenbaum
(74) *Attorney, Agent, or Firm*—Young & Thompson

(57) ABSTRACT

An accelerator member—in the form of a guide member and in particular in the form of an impact member—is strengthened by a strengthening member (110), which strengthening member is provided with a least one attachment side (120). The accelerator block (111) is provided with a least one attachment surface (355). The various aspects being arranged such that at least part of the attachment side of the strengthening member is firmly joined to at least part of the attachment surface of the accelerator block. The strengthening member is made of a structural material that has an appreciably greater tensile strength than the structural material from which the accelerator block is made.

26 Claims, 18 Drawing Sheets

STRENGTHENING PLATE AND METHOD FOR THE USE THEREOF

FIELD OF THE INVENTION

The invention relates to the field of the acceleration of material, in particular a stream of granular or particulate material, with the aid of centrifugal force, with, in particular, the aim of causing the accelerated grains or particles to collide with an impact member at such a velocity that they break.

BACKGROUND TO THE INVENTION

According to a known technique the movement of a stream of material can be accelerated with the aid of centrifugal force. With this technique the material is fed onto the central part (the circular feed surface of a receiving and distributing member) of a rapidly rotating rotor and is then picked up by one or more accelerator members which are carried by the rotor with the aid of a support member and are provided with an acceleration surface that extends from the feed surface in the peripheral direction of the rotor. The material is accelerated along the acceleration surface, under the influence of centrifugal force, and, when it leaves the accelerator member, is propelled outwards at high velocity. Viewed from a stationary standpoint, after it leaves the accelerator member, the material moves at virtually constant velocity along a virtually straight stream that is directed forwards. Viewed from a standpoint moving with the accelerator member, after it leaves the accelerator member, the material moves in a spiral stream that is directed backwards, viewed in the direction of rotation. During this movement the relative velocity increases along the spiral path as the material moves further away from the axis of rotation.

The accelerated material can now be collected by a stationary impact member that is arranged in the straight stream that the material describes, with the aim of causing the material to break during the collision. The material strikes the stationary impact member at the velocity that it has when it leaves the rotor. The stationary impact member can, for example, be formed by an armoured ring that is arranged centrically around the rotor. The comminution process takes place during this single impact, the equipment being referred to as a single impact crusher. Such a device is disclosed in U.S. Pat. No. 5,248,101 (Rose). With this device the actual acceleration on the rotor takes place with the aid of accelerator members in the form of guide members which are arranged around the central part of the rotor. The guide members are provided with a guide surface that extends from the outer edge of the feed surface (central part) in the direction of the periphery of the rotor, usually in a radial direction in the case of single impact crushers. The known guide members are exposed to intense guide wear. Guide members are disclosed in, inter alia, U.S. Pat. No. 6,149,086 (Young), which describes a guide member that is secured with a heavy bolt, U.S. Pat. No. 6,179,234 (Marshall), which describes a specific mounting construction where the accelerator member is firmly anchored in the support member with the aid of centrifugal force, U.S. Pat. No. 5,921,484 (Smith), which describes a guide member that is provided along the guide surface with a cavity in which own material deposits, and WO 02/09878 A1 (Poncen), which describes a guide member that is provided along the guide surface with chambers that can be filled with hard metal.

U.S. Pat. No. 3,767,127 (Wood) discloses an accelerator member—which is of particular importance with regard to the accelerator member according to the invention—which is of symmetrical V-shaped construction and is provided with two acceleration surfaces, which V-shaped accelerator member has the point directed towards the axis of rotation and bears on a V-shaped support member, against which it anchors firmly under the influence of centrifugal force. A symmetrical accelerator member of this type has the advantage that the rotor is operational in both directions, as a result of which the tool life is doubled and the wear material is consumed more effectively, whilst as a result of the simple mounting the parts are very easy to replace and do not have to be specially secured.

Instead of allowing the material to impinge directly on a stationary impact member, it is also possible first to allow the material to impinge on a co-rotating impact member associated with the accelerator member, which co-rotating impact member is carried by the rotor and is arranged transversely in the spiral stream which the material describes, with the aim of allowing the material to collide once before the material strikes the stationary impact member. The material now impinges on the co-rotating impact member at the velocity which the material develops along the spiral path, the material being simultaneously loaded and accelerated during the impact, with which velocity the material is then loaded for a second time when it strikes the stationary impact member. With this arrangement there is said to be a direct multiple impact crusher, which has a much higher comminution intensity than a single impact crusher. A direct multiple impact crusher is disclosed in PCT/NL97/00565, which was drawn up in the name of the Applicant. The direct multiple impact rotor can also be of symmetrical construction, which makes it possible to allow the rotor to operate in both directions. A device of this type is disclosed in PCT/NL00/00668, which was drawn up in the name of the Applicant. It is also possible to allow the multiple impact crusher (and also the single impact crusher) to rotate about a horizontal axis instead of about a vertical axis. Such a device is disclosed in PCT/NL00/00317, which was drawn up in the name of the Applicant.

High forces are exerted on the accelerator members (and the support members) mainly by centrifugal force in the case of guide members and by a combination of (1) centrifugal force and (2) rapidly repeating impulse loading in the case of impact members. The centrifugal force increases progressively with (1) the rotational velocity and (2) the weight (mass) of the impact member, in which context a centrifugal force in excess of 100 kN can be considered under practical conditions. The impulse (impact) loading increases progressively with (1) the diameter (mass) and (2) the hardness (elasticity) of the impinging material, in which context grains with a weight of 1 to 2 kg which impinge repeatedly at a velocity of 50 to 100 m/sec can be considered under practical conditions.

Because the material from which the accelerator members are made must have a high resistance to wear, this material must be as hard as possible (Rc>55/60). Such a material is brittle and consequently not well able to withstand the tensile forces which are generated by the centrifugal loading and the impulse loading. Consequently, fracture can occur in the accelerator members, as a result of which part of the accelerator member, or the entire accelerator member, is propelled outwards at high velocity, which gives rise to a substantial imbalance. This can cause severe damage. Moreover, wear on the guide members is concentrated:

In the case of guide members a channel in which wear is concentrated forms fairly rapidly along the guide surface, as a result of which a deep channel forms fairly rapidly. This weakens the guide member, which can break as a result.

In the case of co-rotating impact members the movement (direction of movement) of the stream of material between the accelerator member and the co-rotating impact member is invariant (with respect to the rotational velocity) and is essentially deterministic. As a result, the material impinges on the co-rotating impact member in a highly concentrated manner. As a result a deep cavity can form fairly rapidly in the impact surface. The impact member is consequently severely weakened, as a result of which it can break.

In order nevertheless to achieve a reasonable tool life, the known accelerator members must therefore be of extra heavyweight construction, so that no pieces start to break away when channels and cavities form. As a result of this additional weight, the mounting construction (and the support member) must also be made extra heavy, which makes the wear parts even heavier, and special provisions have to be made in order to fix the heavy accelerator member well to the support member. As a result of the low tensile strength of the hard, and consequently brittle, wear material, the accelerator members must for this be provided with extra heavy hooks and large projections and the mounting must be secured, for which bolts are often needed. All of this makes the replacement of the wear parts complicated and time-consuming, whilst the tool life, certainly in the case of abrasive material, remains restricted. An additional aspect that is certainly equally important is that a large amount of wear material remains; this is at least the additional portion that is needed to ensure that the accelerator member does not break and the additional structural material for the mounting. Frequently only 25% of the wear material is actually consumed.

As has been stated V-shaped accelerator members make a simple mounting possible. The problem, however, is that the stresses concentrate in the V-shaped pointed part. As a result fracture easily takes place at the location of the V-shaped point in the known V-shaped accelerator member, as a result of which the accelerator member breaks into two parts which are then propelled outwards. U.S. Pat. No. 3,652,023 (Wood) discloses a V-shaped accelerator member that is constructed as a triangle closed all round, which is provided with an opening in the middle, with the aid of which the accelerator member is mounted. An accelerator member of this type is stronger than an open V-shaped accelerator member, but the configuration demands a large amount of additional wear material that cannot be utilised. This type of V-shaped accelerator member is consequently not really effective. It is clear that a V-shaped accelerator member has major advantages. Nevertheless, despite numerous attempts to achieve this, effective utilisation of the V-shape has never been really successful because of the brittleness of the wear material.

In the case of the known guide members which are provided along the guide surface with one or more cavities in which own material deposits, a weak construction can be produced under the effect of wear, as a result of which fracture can occur. The same applies in the case of guide members where such cavities are filled with hard metal.

U.S. Pat. No. 3,346,203 (Danyluke) describes an autogenous rotor which is provided with an impeller vane with two arms which form pockets which fill with own material and act as an accelerating surface. To obtain a reasonable standtime the pockets are equipped with a notch which acts as a tip-end and channels the material from the autogenous accelerator surface to the next pocket and from there along a second tip-end (notch) out of the rotor. The notch consists out of a steel extension which is along one surface equipped with a lines of highly abrasive material to protect the notch, creating a sandwichconstruction. From the notch two sides, one of the liner and one of the sandwich extension/liner, act as sliding surface because the material moves around a corner of the notch (tip-end). Many other similar type tip-ends have been disclosed in the patent literature.

U.S. Pat. No. 6,033,791 (Smith et al) describes a wear resistant high impact iron alloy accelerating member, for accelerating particle material by sliding, that along the sliding surface is provided with an insert that is filled with a layer of carbide granules which are encapsulated in a matrix of white iron (the same white iron that is used for the white iron alloy member that is provided with the insert) to form a particle reinforced (large particle strengthened) composite accelerator member. The accelerator member and the layer are casted together; therefore the mold is (has to be) provided with a molding insert. The resulting casting is then heat treated (precipitation hardening) to obtain the required strength and hardness of the white iron. The molding insert must be capable of remaining in the cast member without significantly effecting its strength, impact resistance or wear resistance; that is, during casting and heat treatment. The result is a cast white iron alloy accelerator member having a high wear resistant region of matrix of particulate carbide contained in a selection location; here along the accelerating surface. This way the accelerator member exhibits and improved resistance to wear. To keep the layer in place when loaded by centrifugal forces and sliding and impact forces, the layer has to have a tensile strength that is at least as high as that of the white iron block that supports the layer. Therefore, it is for the known accelerator block most preferred to use tungsten carbide granules having a relatively high 12 to 18 weight % of cobalt content to achieve the required tensile strength (tensile strength of tungsten carbide increases progressively with the amount of cobalt added but the cobalt reduces the wear resistance; therefore, normally cobalt content is 5–10 weight %). Another problem with the known accelerator member is that the fixing member is made of (is part of) hardened white iron member (block) which is very hard but also very brittle and can therefore break off under influence of the high centrifugal forces and sliding and impact forces. To avoid this the velocity has to be limited; actually, this also applies for many other known accelerator members, which are provided with a similar fixing arrangement.

AIM OF THE INVENTION

The aim of the invention is, therefore, to provide an accelerator member as described above that does not have these disadvantages, or at least displays these to a lesser extent.

To this end the invention provides a possibility for strengthening the accelerator member—in the form of a guide member and in particular in the form of an impact member—with a strengthening member, such that the accelerator member does not give way, crack or break when a high load is exerted on the impact member (accelerator member), which high load occurs in particular when large grains impinge on the accelerator member at high impact velocity.

The accelerator member according to the invention concerns a separate accelerator member for a rotor, which accelerator member consists out of a accelerator block which along one side is provided with a strengthening member; and is not to be used as a tip-end for an accelerator member, in particular autogenous accelerator members as described above. However, the invention provides in the possibility for the accelerator member to be provided with a tip-end.

The rotor with accelerator member according to the invention comprises:

a rotor that is able to rotate about an axis of rotation in at least one direction of rotation;

a metering member for metering the material onto the rotor;

at least one accelerator unit, that at least consists out of one separate accelerator member, for accelerating the metered material in at least one phase, which accelerator member is carried by the rotor with the aid of a separate support member, in such a way that the accelerator member can be dismantled for replacement because of wear, which accelerator member is some distance away from the axis of rotation, which accelerator member consists out of no more then one accelerator block in case the rotor is able to rotate in one direction of rotation and out of maximum two identical accelerator blocks in case the rotor is able to rotate in both directions of rotation, one block side of the accelerator block acts as the acceleration surface of the accelerator member and serves to accelerate the metered material, which acceleration surface at least partially extends in the direction of the periphery of the rotor;

where the accelerator block is provided with one strengthening member, which strengthening member is provided with an attachment side, of which accelerator block the block side which is situated essentially opposite of the acceleration surface is provided with an attachment surface, such that at least part of the attachment side of the strengthening member and at least part of the attachment surface of the accelerator block are joined together to form a structural composite accelerator member, which strengthening member is made of a structural material that has an appreciably greater tensile strength than the structural material from which the accelerator block is made, wherein the composition of the alloys of the strengthening member and the accelerator block are different and chosen in such a way that when the casted accelerator member is subject to thermal after treatment the accelerator block develops the desired hardness and the strengthening member retains the desired tensile strength, and the strengthening member is provided with at least one fixing member for joining the accelerator member to the support member. The invention is further described in the claims, to which reference is made here.

The strengthening member holds the accelerator block material together when this comes under stress, even when cracks arise. This makes it possible to make the accelerator member of less heavyweight construction and even to make it slim compared with an accelerator member that is not provided with a strengthening member and is loaded in the same way. The high tensile strength of the strengthening member furthermore makes it possible to provide the accelerator member with simple and lightweight (restricted volume) connector and fixing members by means of which the accelerator member is joined to the support member, or two accelerator members can be joined to form an assembled (V-shaped) accelerator member, as a result of which both the accelerator member and the support member need to be of less heavyweight construction and can be constructed in a manner that makes rapid replacement of the wear parts possible.

The accelerator member according to the invention therefore consists of an accelerator block that is made of a hard (Rc 55–65) wear material having a low tensile strength and a (metal) strengthening member having a high tensile strength (and lesser hardness).

The term strengthening plate is also used to designate all other shapes if these do not specifically have the appearance of a plate.

In this context the invention provides a possibility for the strengthening member to be partially external and partially internal and provides a possibility for the strengthening member partially to protrude freely from the accelerator member, for example to protect the support member, or fixing with the aid of a clamping member.

The strengthened accelerator member can be used for a single rotor with which the acceleration of the material takes place in one phase and the strengthened accelerator member acts as guide member, for an associated accelerator unit with which the acceleration takes place in (at least) two phases, the first phase in the form of acceleration by guiding and the second phase by acceleration by striking, the strengthened accelerator member acting as accelerator member associated with a non-strengthened impact member, or where a non-strengthened guide member is associated with a strengthened accelerator member that acts as (impact) strike member or use is made of a strengthened accelerator member for both acceleration phases.

The aim of the invention is specifically targeted at the use of the strengthened accelerator member as said (co-rotating) impact member. Here material is understood to be a fragment, grain or a particle or a stream of fragments, grains or particles, designated here in general as material of non-uniform shape.

A further aim of the invention is to construct the accelerator member with the aid of the strengthening member in such a way that the accelerator member can easily be joined to the support member and replaced.

The accelerator member can be constructed as a single accelerator member with a single accelerator block, but can also be constructed symmetrically in, for example a V-shape (or an essentially truncated V-shape) with two accelerator blocks, which latter assembled configuration is preferred, where:

the accelerator member is mirror symmetrical with respect to a plane of symmetry from the axis of rotation that intersects the accelerator member halfway between the two accelerator blocks and is provided with two impact blocks;

the accelerator member is mirror symmetrical with respect to a plane of symmetry from the axis of rotation that intersects the accelerator member halfway between two acceleration surfaces;

the strengthening member is mirror symmetrical with respect to a plane of symmetry from the axis of rotation.

The invention provides a possibility for the V-shaped accelerator member to consist of a (single) accelerator block or to be made up of two (identical) accelerator blocks to give an assembled accelerator block, it being possible for the accelerator blocks to be linked to one another at the location of the V seam with the aid of a linking member; in this context consideration can be given to a hook connection, a connection with a pin or bolt, but also to a weld or other join, for example a clamping member, whilst the accelerator members can also be linked with the aid of the support member to give a V-shaped accelerator member. The strengthening plate is preferably made of metal which has a sufficiently high tensile strength and a thickness such that the stresses (in the V seam) can be absorbed.

An additional advantage is that a bed of own material (to be crushed) is able to deposit at the location of the outside of the V-shaped point between the accelerator blocks under the influence of centrifugal force: this prevents wear on, or damage to, the connecting member or the strengthening member being able to occur at the location of the V-shaped point.

The assembled accelerator member according to the invention provides a possibility for the strengthening member to be provided with a fixing member in the form of an open or half-closed hook, a projection or of studs or threaded openings by means of which the accelerator member can be fixed or secured to the support member in such a way that it is firmly anchored under the influence of centrifugal force.

Thus, a distinction is made between (1) single accelerator members with one or two (V-shaped) acceleration surfaces and (2) an assembled accelerator member that consists of two identical (single) accelerator members, which two accelerator members are joined to one another (to give a V-shape) with the aid of (1) a connecting member or with the aid of (2) the support member.

A V-shaped accelerator member is understood to be (1) a single or assembled accelerator member where the accelerator members are each fixed with one edge in direct contact with one another in such a way that a V-shape or truncated V-shape is produced, (2) a single or assembled guide member where the edges of the strengthening members are not in direct contact with one another, in other words are some distance apart, such that essentially there can be said to be a sort of truncated V-shape.

At least along the impact surface, the accelerator block consists of a material which has a hardness that is the same as or greater than that of the material to be accelerated. The invention provides a possibility for the accelerator block to be provided with one or more hard metal elements, where the term hard metal is used here to refer to, preferably, tungsten carbides, which tungsten carbides can also be fixed in place by welding on. The invention provides a possibility for the material from which the accelerator block is made at least partially consists of ceramic material.

The accelerator member according to the invention provides a possibility for the accelerator member to be mounted on hinges.

The firm bond between the strengthening member and the accelerator block along the attachment surface can be achieved with the aid of heat. The accelerator block can be applied in the fluid state to the strengthening plate, but can also be applied in some other way, for example in the form of a spray. In this context it is preferable to heat the strengthening member beforehand to a temperature approximately the same as that of the material of the accelerator block that is to be joined thereto by cohesion (that is to be cast on) and to treat the strengthening member beforehand along the attachment side with a special agent that promotes cohesion.

The cohesion between the attachment side (of the strengthening member) and the attachment surface (of the accelerator block) can be achieved with the aid of heat treatment, the invention providing, inter alia, the following production methods:

According to a first production method the strengthening member and the accelerator block are cast immediately one after the other and specifically the strengthening member is cast using a first melt and the accelerator block is cast against the attachment side immediately thereafter using a second melt, at the point in time when the first melt is still in the fluid state, or at least the attachment side is at a temperature such that complete fusion of the first and second melt takes place along the attachment surface/side, wherein the alloys of the first and second melt are not identical, wherein the composition of the alloys is so chosen that when the accelerator member is subjected to thermal after-treatment the accelerator block develops the desired hardness and the strengthening member retains the desired tensile strength, wherein the attachment side describes an essentially straight surface, wherein the attachment side describes an essentially horizontal surface during the production of the accelerator member, wherein, after the strengthening plate has been cast, the attachment side is first provided with a film of an agent that prevents, or at least as far as possible prevents, oxidation occurring along the attachment side.

According to another production method, the accelerator block is cast against a strengthening member in the form of a piece of plate material. With this procedure it is preferable, before the accelerator block is cast, to bring the metal plate to a temperature that is approximately the same as the temperature of the melt, wherein, during the production of the accelerator member, an additional layer of melt material is also applied to the back of the metal plate, that is the side opposite the attachment side, so that the metal plate assumes virtually the same temperature as the melt, which additional layer is then removed, for which purpose the back is provided with a film of an agent which prevents cohesion between the back and the melt cast on.

The cohesion along the attachment side can also be achieved with the aid of sintering and with the aid of soldering.

BRIEF DESCRIPTION OF THE DRAWINGS

For better understanding, the aims, characteristics and advantages of the device of the invention which have been discussed, and other aims, characteristics and advantages of the device of the invention, are explained in the following detailed description of the device of the invention in relation to accompanying diagrammatic drawings.

BEST WAY OF IMPLEMENTING THE DEVICE OF THE INVENTION

A detailed reference to the preferred embodiments of the invention is given below. Examples thereof are shown in the appended drawings. Although the invention will be described together with the preferred embodiments, it must be clear that the embodiments described are not intended to restrict the invention to those specific embodiments. On the contrary, the intention of the invention is to comprise alternatives, modifications and equivalents which fit within the nature and scope of the invention as defined by appended claims.

Figure 1:
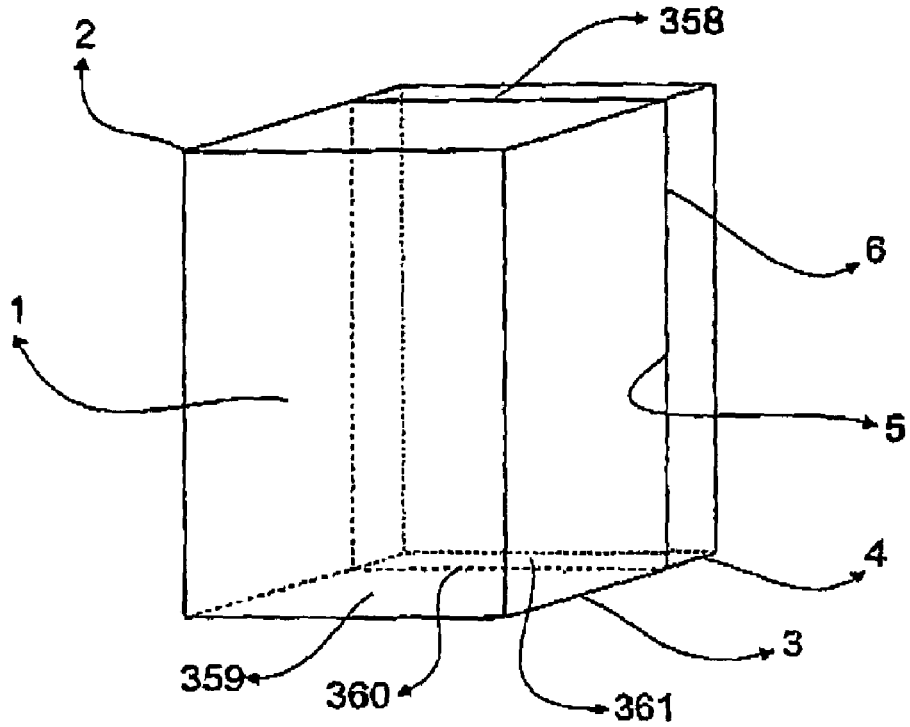
FIG. 1 shows, diagrammatically, a first embodiment of a single accelerator member.

FIG. 1 shows, diagrammatically, a first embodiment of a single accelerator member (1), which accelerator member (1) is carried by a rotor (not shown here) with the aid of a support member (not shown here), which accelerator member (1) is provided with an accelerator block (2), which here describes a rectangle, one block side of which accelerator block (2), in this case the front side, acts as acceleration surface (3) for accelerating material that is metered onto the rotor with the aid of a metering member (not shown here), the accelerator block (2) being provided with a strengthening member (4), in this case an external strengthening member in the form of a strengthening plate, which strengthening member (4) is provided with an essentially straight attachment side (5), in this case a plate surface, which accelerator block (2) is provided with an essentially straight attachment surface (6), in this case the back, which attachment side (5) is firmly joined along the attachment surface (6), along an essentially straight attachment plane (358) to form a structural (laminar) composite accelerating member (1) where said accelerator block (2) is essentially located on one side (359) of a straight dividing plane (360) on which is situated said attachment plane (358) and said strengthening member (4) is essentially located on the other side (361) of said dividing plane (360); in this case the entire back of the accelerator block (2), to the accelerator block (2) over an entire plate side, which strengthening member (4) is made of a material that has a higher tensile strength than the material from which the accelerator block (2) is made, which accelerator block (2) is made of a material that is at least as hard as the material that is accelerated with the aid of the acceleration surface.

The strengthening member is provided with a fixing member for connecting (joining) the accelerator member to the support member; but this is not shown here.

It is clear that the attachment plane cannot be completely straight when the accelerator member is casted against the still fluid casted strengthening member; however for this production method it is a necessity that the attachment side describes an essentially horizontal surface during the casting of the accelerator block (accelerator member). The accelerator member (1) is able to act as a guide member, the acceleration surface (3) acting as a guide surface for accelerating the material with the aid of guiding, and as an impact member, the acceleration surface (3) acting as an impact surface for accelerating the material by striking.

This construction prevents pieces of the accelerator block (2), which is made of a hard and consequently brittle material with low tensile strength, from breaking off as a result of loading by material that collides with the acceleration surface (3) at high velocity. The strengthening member (4) as it were holds the accelerator block (2) together. Cracks can form in the accelerator block (2) as a result of the loading, but the strengthening member (4) prevents pieces, or at least large pieces, breaking off; it is clear that if the loading is too great or when the accelerator member (1) (accelerator block (2) and strengthening member (4)) wears through (large) pieces can still break off and damage to the support member (not shown here) can occur.

Figure 2:
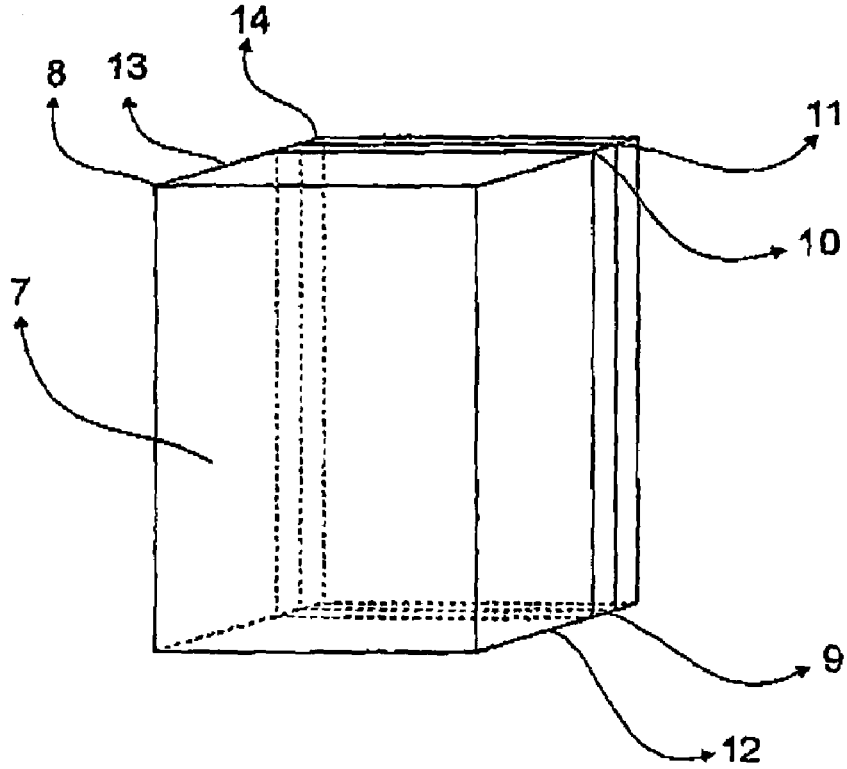
FIG. 2 shows, diagrammatically, a second embodiment of a single accelerator member.

FIG. 2 shows, diagrammatically, a second embodiment of a single accelerator member (12), essentially the same as the accelerator member (1) from FIG. 1, consisting of an accelerator block (8) and an internal strengthening member (9), the strengthening member (9) being in the form of a strengthening plate that is provided with two plate surfaces (10)(11), at least part of each of which plate surfaces (10)(11) acting as attachment side, which strengthening member (9) extends transversely through the accelerator block (8), in this case in such a way that the plate surfaces (10)(11) are parallel to the acceleration surface (7), the accelerator block (8) essentially consisting of two parts (13)(14), each of which extends along one of the plate surfaces (10) and (11), respectively.

Figure 3:
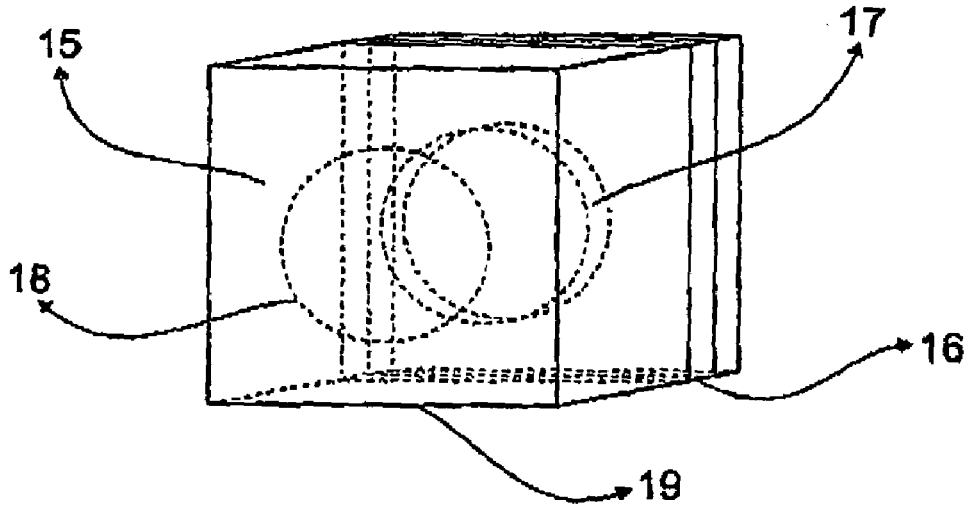
FIG. 3 shows, diagrammatically, a third embodiment of a single accelerator member.

FIG. 3 shows, diagrammatically, a third embodiment of a single accelerator member (15), essentially the same as the second accelerator member (12) from FIG. 2, and preferably to be used as impact member, the strengthening member (16) being provided with an opening (17) through it, which in this case is cylindrical and extends at a position behind the impingement surface (18) of the impact surface (19), where the material to be accelerated strikes the impact surface (19), which opening (17) is filled with accelerator block material. This increases the tool life of the accelerator member (15) because more wear material (wear layer thickness) is available.

The invention provides a possibility for the strengthening member partially to protrude from the accelerator member, whilst the shape of the accelerator block or accelerator member essentially can assume "all possible" shapes. It is important to match the shape of both the accelerator block and the strengthening member as well as possible to the wear pattern and in such a way that the accelerator member can be fixed in an optimum manner to the support member, the strengthening member of which offers unique possibilities because of its high strength and freedom of shape (when casting).

Figure 4:
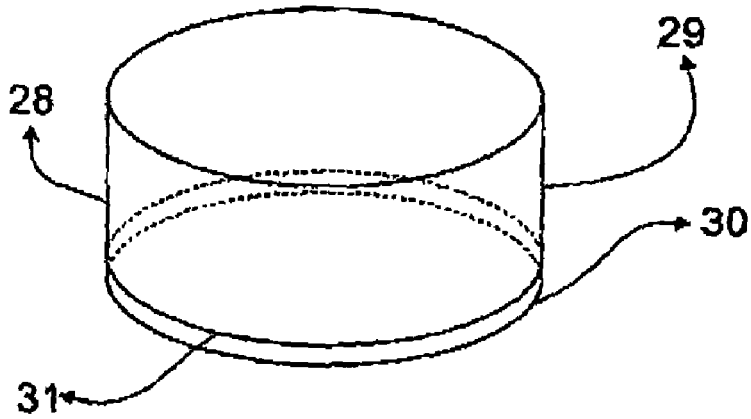
FIG. 4 shows, diagrammatically, a fourth embodiment of a single accelerator member.

FIG. 4 shows, diagrammatically, a fourth embodiment of a single accelerator member (28) where the accelerator block (29) essentially describes a solid of revolution, the strengthening member (30) being affixed to a parallel surface (31) of the accelerator block (29).

Figure 5:
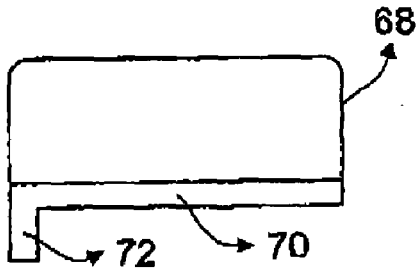
FIG. 5 shows, diagrammatically, a fifth embodiment of a single accelerator member.
Figure 6:
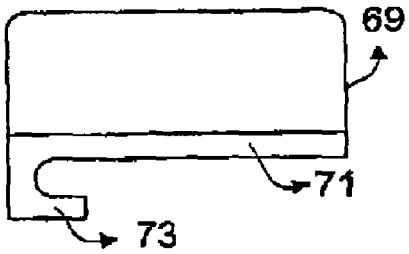
FIG. 6 shows, diagrammatically, a sixth embodiment of a single accelerator member.

FIGS. 5 and 6 show, diagrammatically, a fifth (68) and a sixth (69) embodiment of a single accelerator member, the strengthening member (70)(71) being provided with, respectively, a straight (72) and an angled (half closed) (73) hook for fixing the accelerator member (68)(69) to a support member (not shown here), which support member can be located behind but also underneath the accelerator member, while many other fixing members also being conceivable according to the invention.

Figure 7:
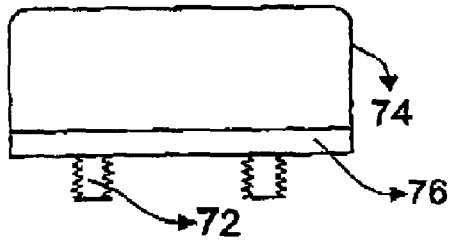
FIG. 7 shows, diagrammatically, a seventh embodiment of a single accelerator member.
Figure 8:
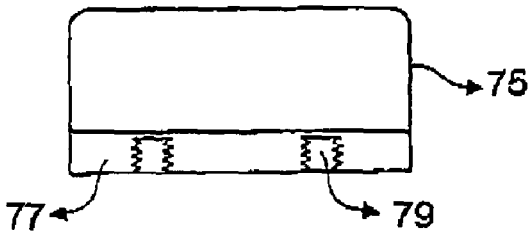
FIG. 8 shows, diagrammatically, an eight embodiment of a single accelerator member.

FIGS. 7 and 8, for example, show, diagrammatically, a seventh (74) and an eight (75) embodiment of a single accelerator member, the strengthening member (76)(77), respectively, being provided with threaded ends (78) and threaded holes (79) for fixing the accelerator member (74) (75) to a support member (not shown here).

It is clear that the fixing plate and also the shape of the accelerator block or the strengthening member can be provided in several ways with fixing members or fixing means for fixing against or to a support member or a direct fixing to the rotor.

Figure 9:
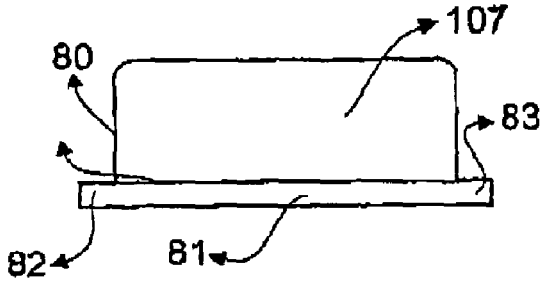
FIG. 9 shows, diagrammatically, a ninth embodiment of a single accelerator member.

FIG. 9 shows, diagrammatically, a ninth embodiment of a single accelerator member (80) provided with an accelerator block (107) and a strengthening member (81), which strengthening member (81) is provided with two protruding parts (82)(83) in the form of protruding edges, it being possible for the strengthening member (81) to be made of a material that can be welded for fixing the accelerator member (80) with the protruding parts (82)(83) to one another (to form an assembled accelerator member, not shown here) or to the support member (not shown here), it being possible to weld two protruding parts to one another in a V-shape (not shown here). The protruding parts can be intended also or solely for protection of the support member (not shown here).

Figure 10:
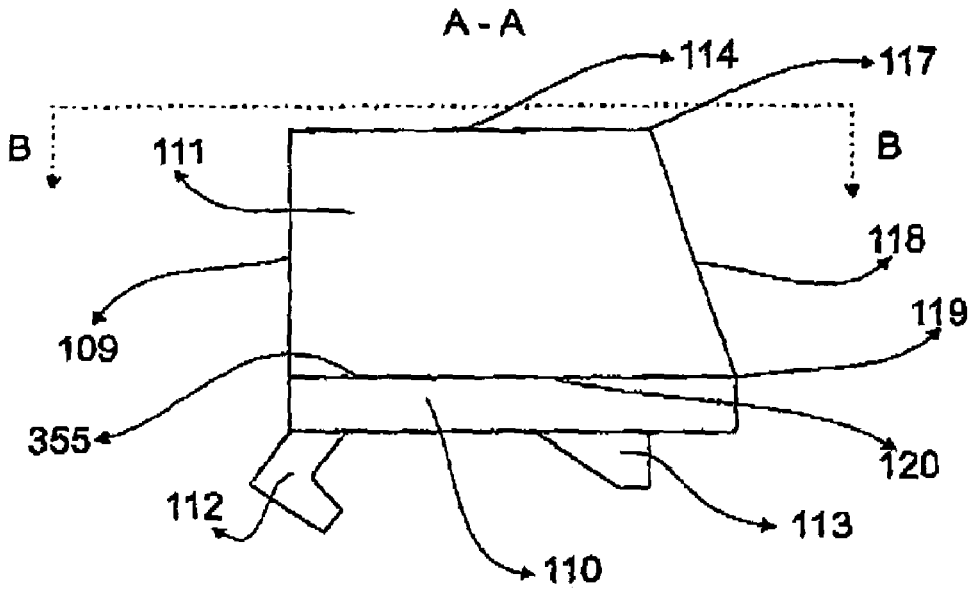
FIG. 10 shows, diagrammatically, a side (transverse) view B—B according to FIG. 11 of a tenth embodiment of a single accelerator member.
Figure 11:
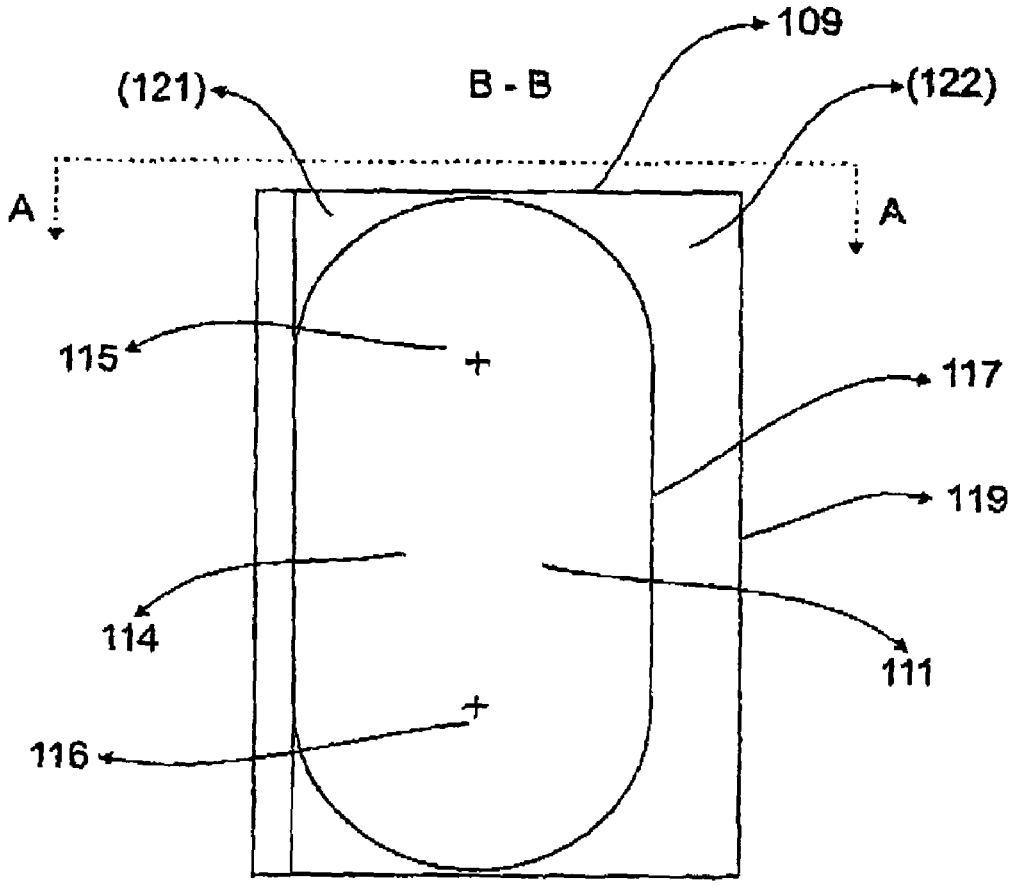
FIG. 11 shows, diagrammatically, a plan (front) view A—A according to FIG. 10 of a tenth embodiment of a single accelerator member.

FIGS. 10 and 11 show, diagrammatically, a tenth embodiment of a single accelerator member (109), which accelerator member (109) is preferably intended as an impact member in the form of an assembled V-shaped accelerator member (not shown here), the strengthening member (110) extending along the back of the accelerator block (111), in such a way that the attachment surface (355) of the accelerator block (111) is firmly joined to the attachment side (120) of the strengthening member (110), which strengthening member (110) is provided with two fixing members (112)(113), i.e. a hook (112) and a projection (113), by means of which the accelerator member (109) is fixed to the support member (not shown here). The accelerator member (109) is provided with an acceleration surface (114) with two impingement surfaces (115)(116) so that the acceleration surface (114), i.e. the accelerator member (109), is reversible with respect to the plane of rotation, the acceleration surface (114) being made oval as a whole and the accelerator block (111) widening (118) from the outer edge (117) of the acceleration surface (114) in the peripheral direction (119) of the attachment side (120) of the strengthening member (110), which strengthening member (110) has a rectangular shape and a larger peripheral than the impact surface (114). The aim with such an embodiment is to prevent corners (121)(122) of the accelerator block (111) breaking off when wear forms a deep hole at the location of the impingement surface (115)(116), whilst at the same time the strengthening member (110) is protected and a saving is made in wear material. It is clear that in this sense it is possible substantially to match the shape, i.e. geometry, of the accelerator block (111) to the wear pattern with the aid of the strengthening member (110).

Figure 12:
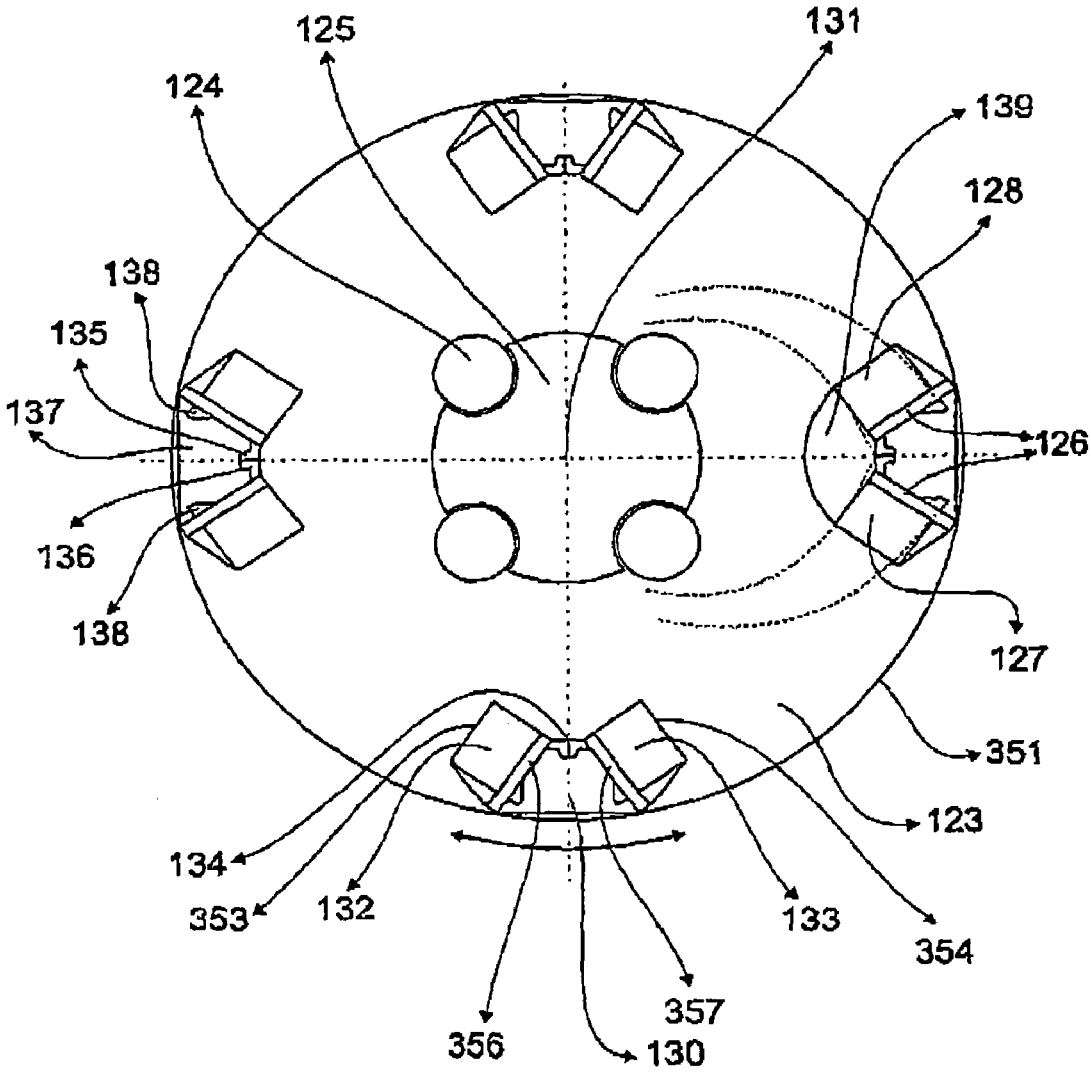
FIG. 12 shows, diagrammatically, a first embodiment of a rotor that is equipped with a first embodiment of an assembled (truncated) V-shaped accelerator (impact) member.

FIG. 12 shows, diagrammatically, a first embodiment of a rotor (123) that is equipped with cylindrical guide members (124) which are arranged around a metering and distribution surface (125), each of which guide members (124) is associated with a first embodiment of an assembled V-shaped accelerator member (126), which in this case acts as a strengthened impact member, which are made up of two single accelerator members (127)(128) in the form of the tenth embodiment of the accelerator member (109) from FIGS. 10 and 11, which assembled accelerator member (126) describes a mirror symmetrical truncated V-shape with respect to a plane of symmetry (130) from the axis of rotation (131) that the assembled accelerator member (126) intersects halfway between the two single accelerator members (127)(128) and is provided with two accelerator blocks (132)(133), each of which is provided with an acceleration surface (353)(354), which acceleration surfaces extend in the direction of the periphery (351) of said rotor (123), the (truncated) point (134) being oriented towards the axis of rotation (131), which accelerator members (127)(128) are linked to one another to the support member (137) with the aid of hooks (135)(136), which form part of the strengthening member (356)(357), and here bear, with the aid of projections (138), which form part of the strengthening member (356)(357), against the support member (137), in such a way that the accelerator member (126) anchors itself firmly against the support member (137) under the influence of centrifugal force. It is clear that the single accelerator members (127)(128) can be replaced very easily and quickly and that the support member (137) is well protected, it being pointed out that a bed of own material (139) deposits between the single accelerator members (127)(128), as a result of which the linking members (hooks (135)(136)) are protected.

Figure 13:
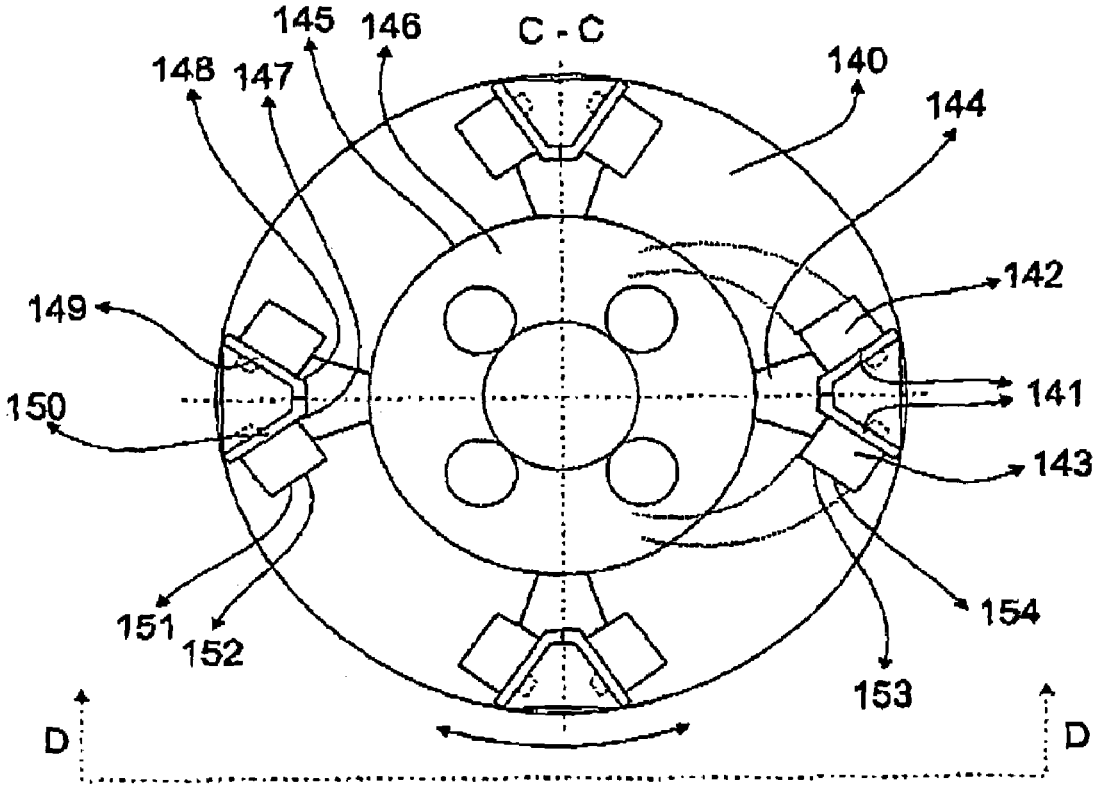
FIG. 13 shows, diagrammatically, a plan view C—C according to FIG. 14 of a second embodiment of a rotor that is equipped with a second embodiment of an assembled (truncated) V-shaped accelerator (impact) member.
Figure 14:
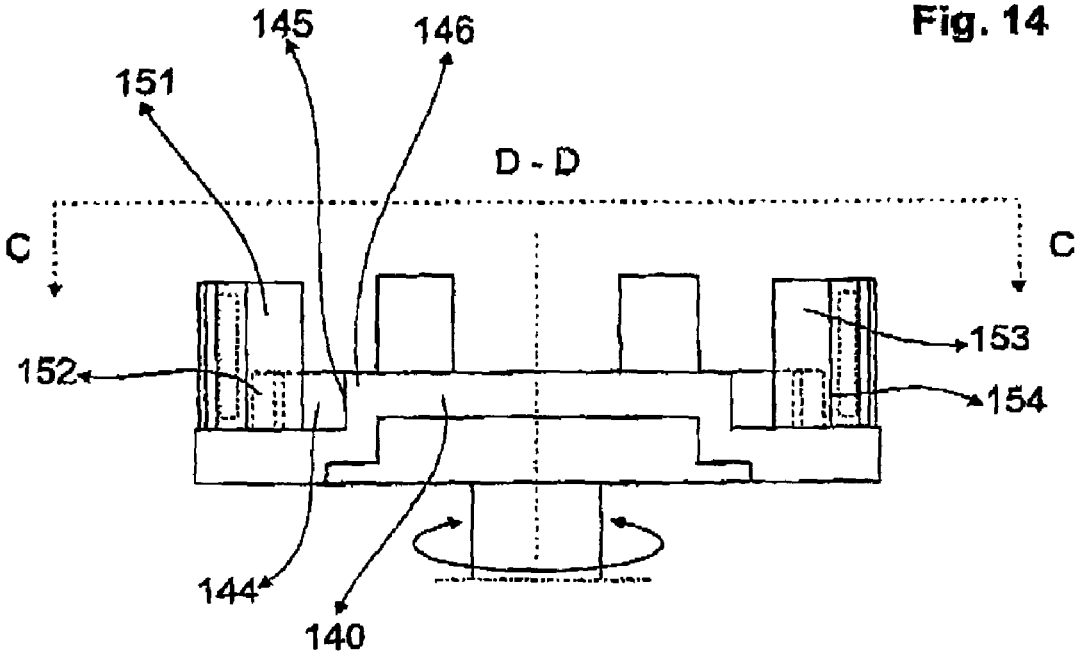
FIG. 14 shows, diagrammatically, a side view D—D according to FIG. 13 of a second embodiment of a rotor.

FIGS. 13 and 14 show, diagrammatically, a second embodiment of a rotor (140), essentially identical to the first embodiment of the rotor (123) from FIG. 12, but here equipped with a second embodiment of an assembled truncated V-shaped accelerator (impact) member (141), the single accelerator members (142)(143) being joined to one another to give the assembled accelerator member (141) with the aid of a removable clamping block (144) that bears on the upright edge (145) of the central part (146) of the rotor (140) and the single accelerator members (142)(143) are held together with the aid of the protruding edges (147)(148) of the single strengthening members (149)(150) (ninth embodiment (80) from FIG. 9). This type of construction makes it possible not only to allow the rotor (140) to operate in both rotational directions but also to make the accelerator member (141) reversible; thus, each assembled accelerator member (141) is provided with four impingement surfaces (151)(152)(153)(154) (see tenth embodiment (109) from FIGS. 10 and 11). Here the impact surface is arranged in the longitudinal direction transversely to the plane of rotation and the accelerator member is therefore reversible with respect to the plane of rotation. The invention provides a possibility for arranging the impact surface in the longitudinal direction in the plane of rotation, with the consequence that the impact member is then reversible in the plane of rotation. For replacement of the accelerator members (141)(142)(143) it is necessary only to remove the clamping block (144). This construction therefore makes rapid replacement possible and makes a long tool life possible, a large proportion of the wear material (up to more than 50%) being effectively consumed.

Figure 15:
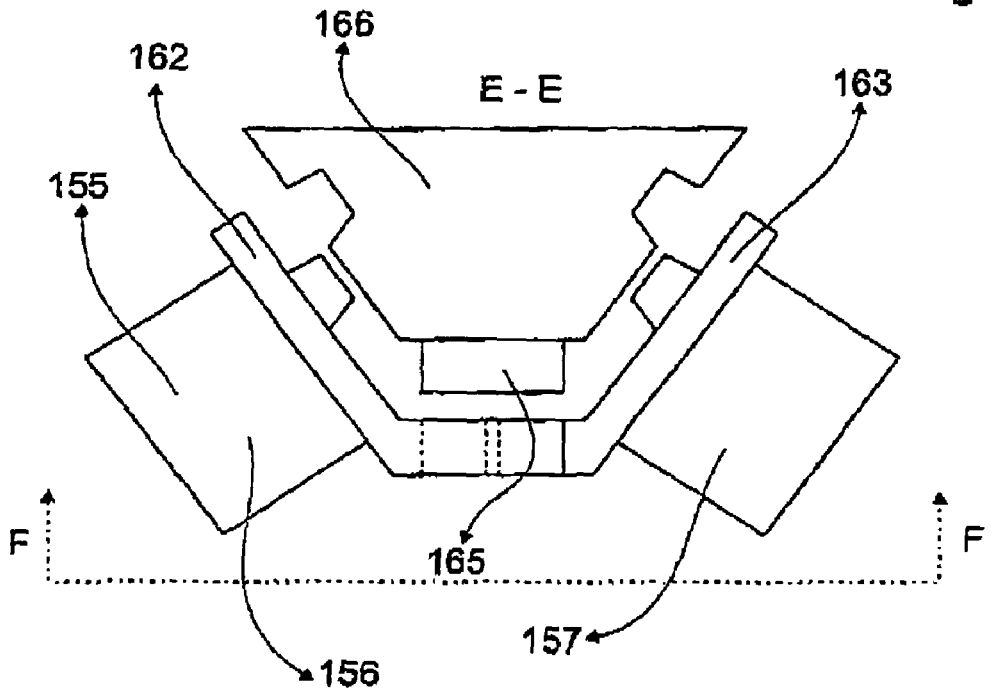
FIG. 15 shows, diagrammatically, a plan view E—E according to FIG. 16 of a third embodiment of an assembled (truncated) V-shaped accelerator member.
Figure 16:
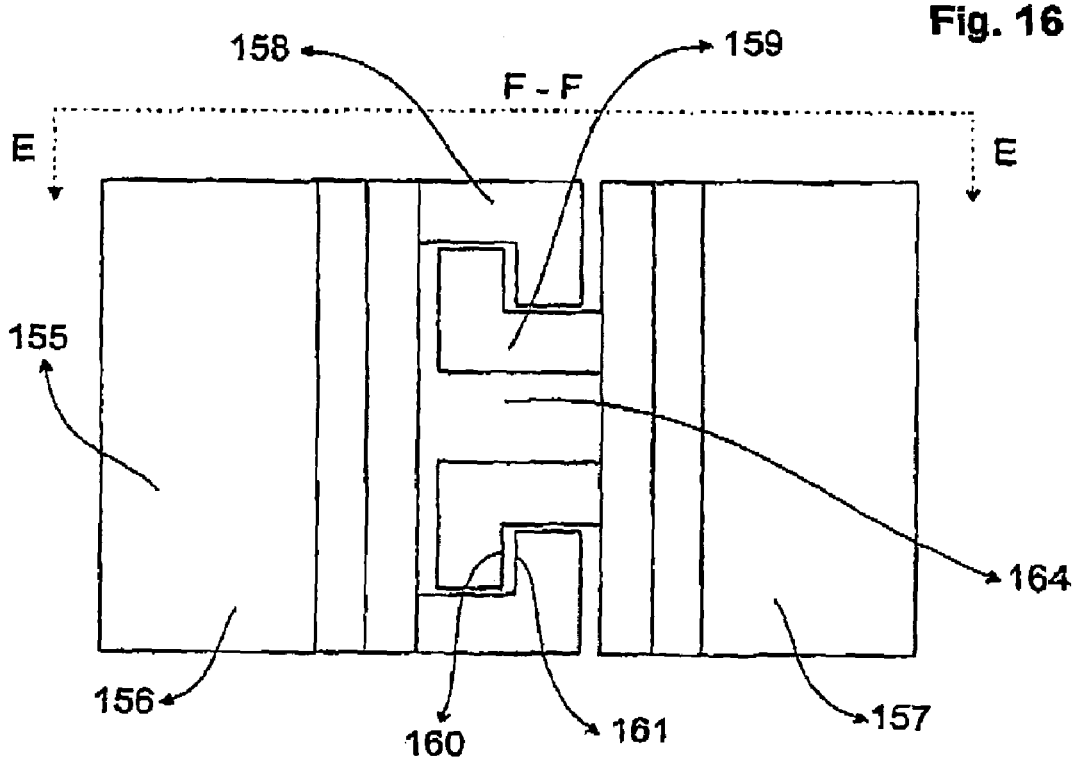
FIG. 16 shows, diagrammatically a side (front) view F—F according to FIG. 15 of a third embodiment of an assembled (truncated) V-shaped accelerator member.

FIGS. 15 and 16 show, diagrammatically, a third embodiment of an assembled (truncated) V-shaped accelerator member (155), intended as an impact member, wherein the two single impact members (156)(157) are linked to one another by a linking member in the form of a hook construction (158)(159), which hooks (160)(161) form part of the strengthening members (162)(163); halfway between the hook constructions (158)(159) an opening (164) has been left, in which a projection (165) of the support member (166) fits, in such a way that the accelerator member (155) is not able to move upwards under the influence of centrifugal force.

Figure 17:
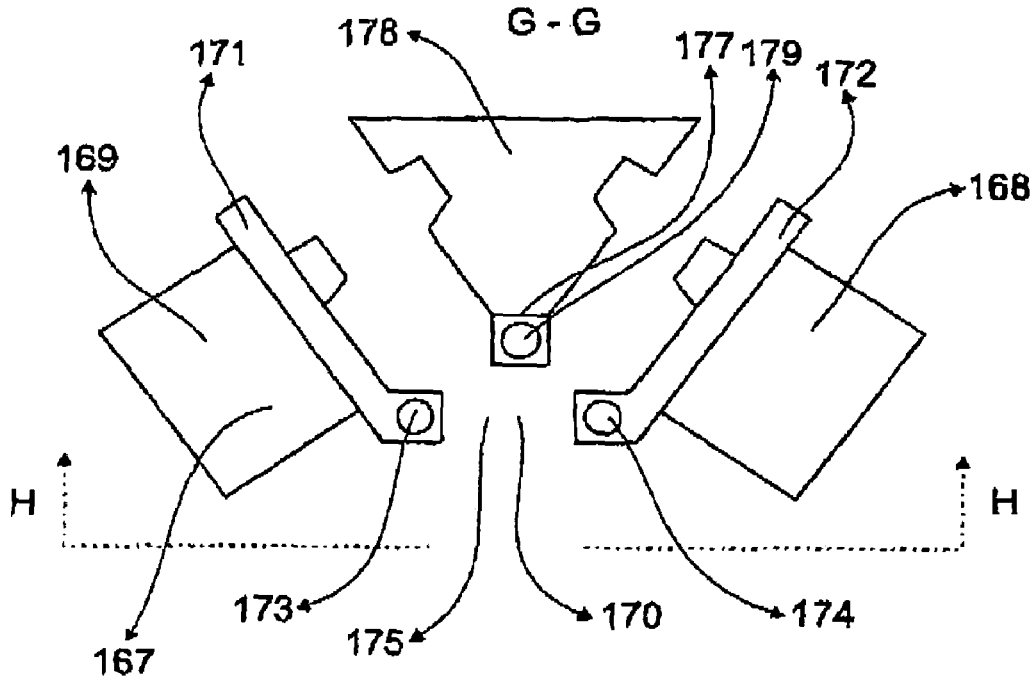
FIG. 17 shows, diagrammatically, a plan view G—G according to FIG. 18 of a fourth embodiment of an assembled (truncated) V-shaped accelerator member.
Figure 18:
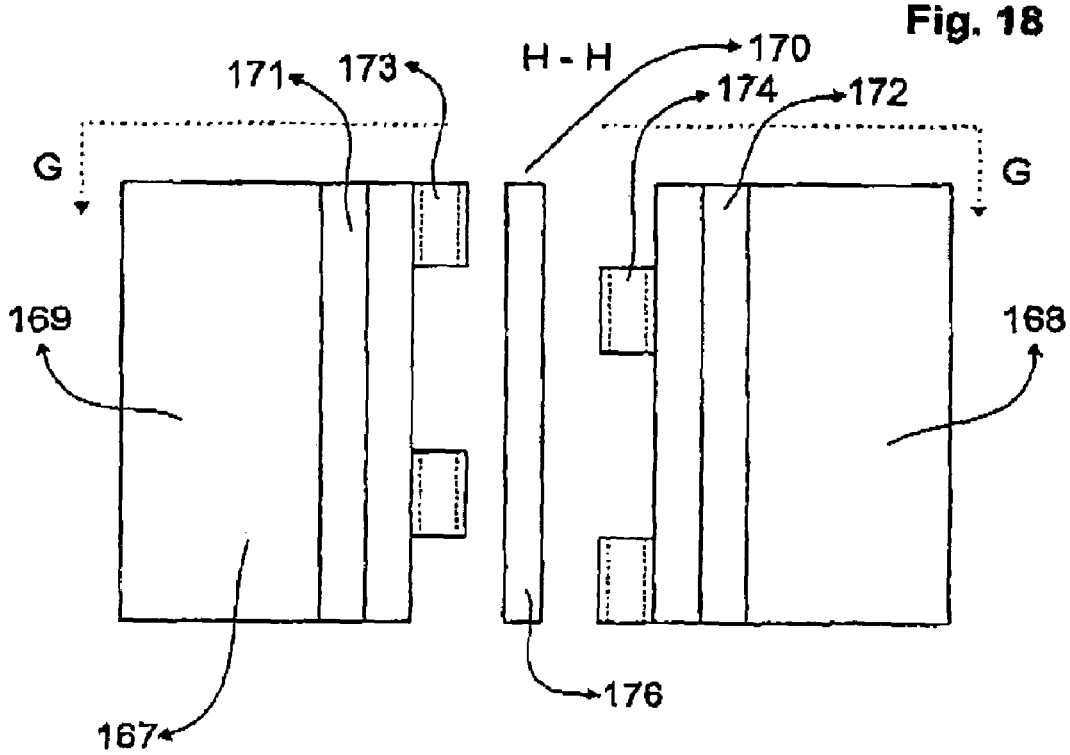
FIG. 18 shows, diagrammatically, a side (front) view H—H according to FIG. 17 of a fourth embodiment of an assembled (truncated) V-shaped accelerator member.

FIGS. 17 and 18 show, diagrammatically, a fourth embodiment of an assembled (truncated) V-shaped accelerator member (167), intended as an impact member, wherein the two single impact members (168)(169) are linked to one another by a linking member (170) in the form of a pin construction, for which the respective strengthening members (171)(172) are provided with holes (173)(174), such that these members can be linked at the V-shaped point (175) with a pin (176) that extends through these holes (173)(174), with the possibility that the point (177) of the V-shaped support member (178) is also provided with a hole (179), such that the assembled accelerator member (167) is also firmly linked to the support member (178) with the aid of this pin (176). The pin (176) then has the function of a linking member and fixing member.

Figure 19:
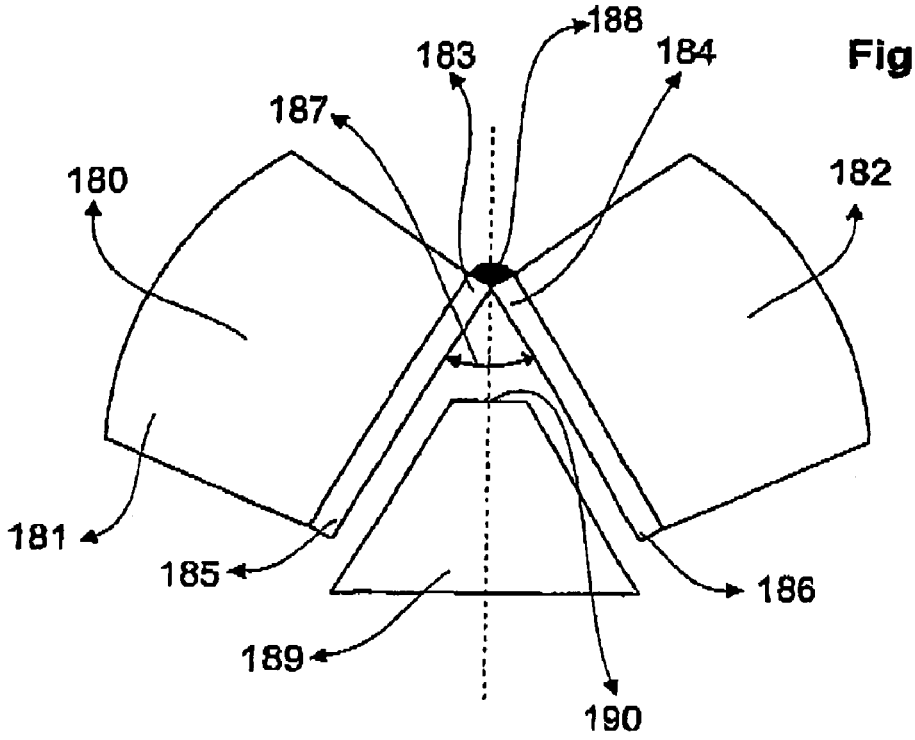
FIG. 19 shows, diagrammatically, a fifth embodiment of an assembled V-shaped accelerator member.

FIG. 19 shows, diagrammatically, a fifth embodiment of an assembled V-shaped accelerator member (180), intended as an impact member, where the V-shape is achieved by welding (188) the two single accelerator members (181)(182) to one another at the location of the edges (183)(184) of the strengthening members (185)(186) at an angle (187). Because here it is more difficult to achieve accurate joining at the corner (188), it is preferable to construct the V-shaped support member (189) with a truncated point (190).

Figure 20:
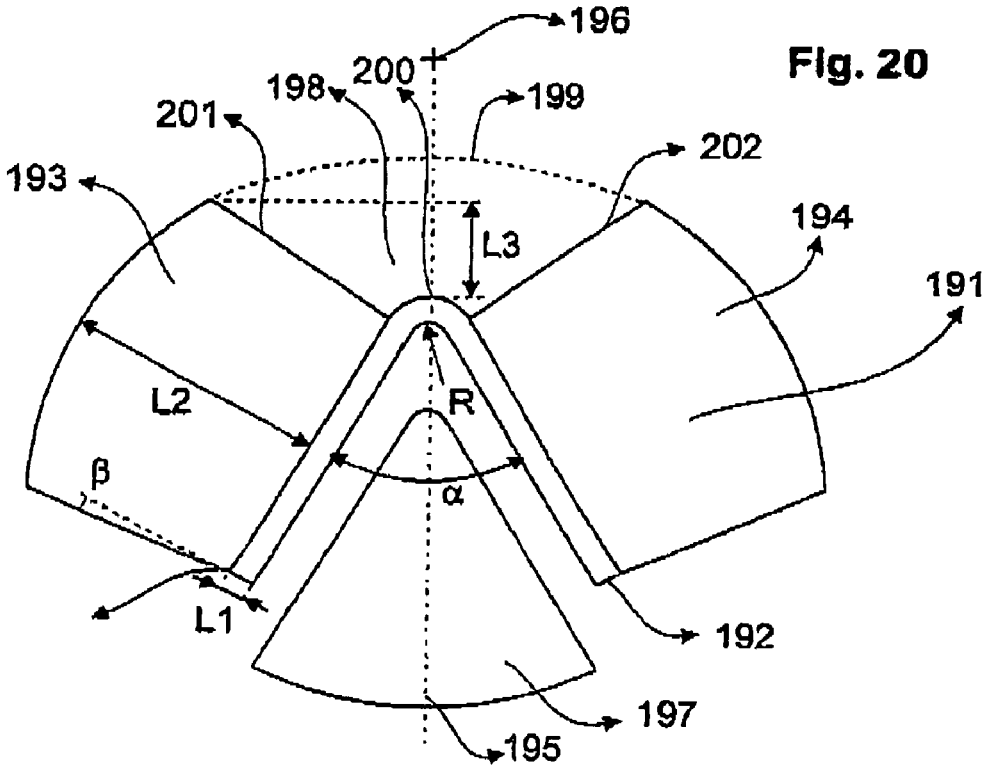
FIG. 20 shows, diagrammatically, a first embodiment of a single V-shaped accelerator member.

FIG. 20 shows, diagrammatically, a first embodiment of a single V-shaped accelerator member (191), wherein the accelerator member (191) is provided with a V-shaped strengthening member (192) and two essentially identical accelerator blocks (193)(194) firmly joined thereto, which accelerator blocks are joined independently of one another, in a mirror symmetrical configuration, to the strengthening member (192), in such a way that the accelerator member (191) is mirror symmetrical with respect to a radial plane of symmetry (195) from the axis of rotation (196). The V-shaped accelerator member (191) can be carried (by a rotor (not shown here)) with the aid of an essentially V-shaped support member (197) that comes into contact with the V-shaped strengthening member (192). On a rotor (not shown here), the space (198) between the accelerator blocks (193)(194) fills with a bed of own material (199) under the influence of centrifugal force, as a result of which damage along the open section (200) of the strengthening member (192) and the inward-facing surfaces (201)(202) of the accelerator blocks (193)(194) is prevented. The bent V has the advantage that the support member (197) is able to abut well in the V. Such a construction has the advantage that the accelerator member (191) anchors itself firmly against the support member (197) under the influence of centrifugal force and does not need to be further secured, whilst replacement is very easy. The strengthening member (191) can thus be bent into the V-shape before or after casting on the accelerator blocks (193)(194).

Figure 21:
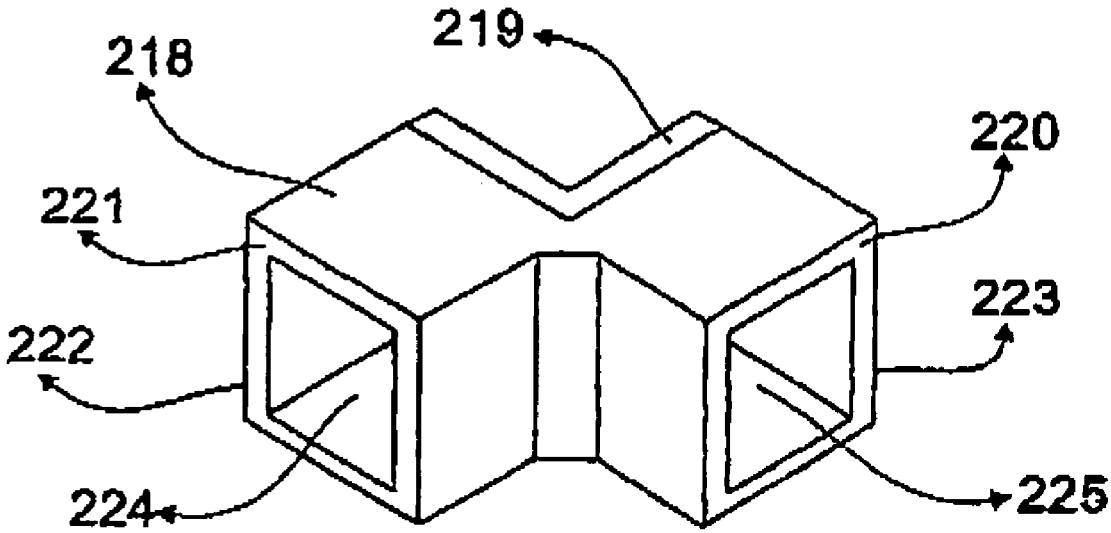
FIG. 21 shows, diagrammatically, a second embodiment of a single V-shaped accelerator member.

FIG. 21 shows, diagrammatically, a second embodiment of a single V-shaped accelerator member (218), wherein the strengthening member (219) extends along the back, wherein the accelerator blocks (220)(221) contain a cavity (224)(225) along the acceleration surface (222)(223), in which cavities (224)(225) an autogenous bed of metered material is able to deposit under the influence of centrifugal force, which makes it possible to save an appreciable amount of wear material, i.e. appreciably to increase the tool life. It is clear that multiple cavities are possible.

Figure 22:
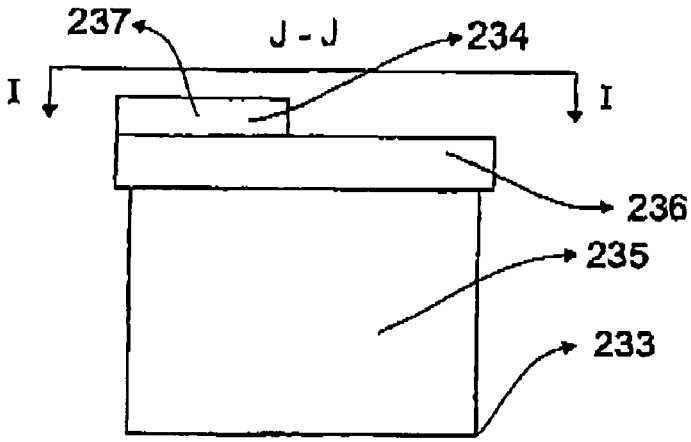
FIG. 22 shows, diagrammatically, a side (transverse) view J—J according to FIG. 23 of a first embodiment of a single accelerator member with dovetail connector.
Figure 23:
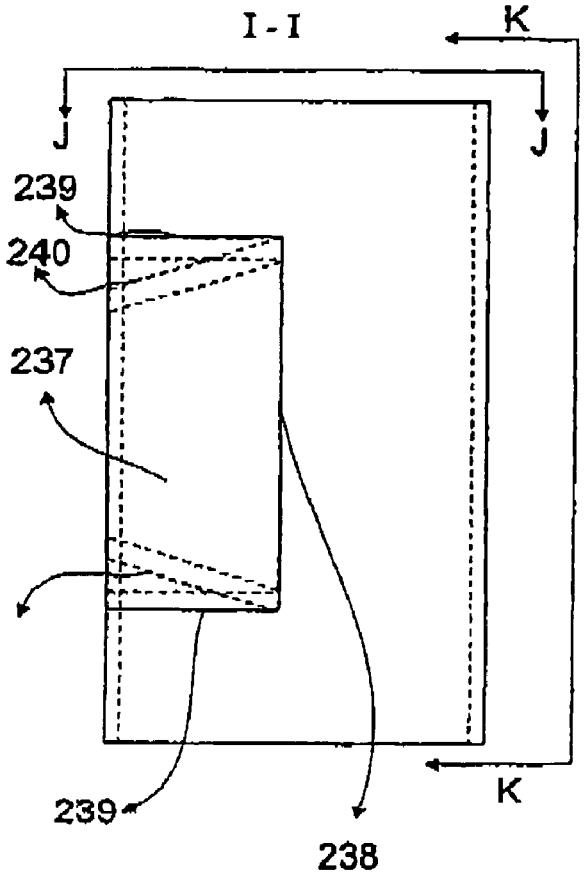
FIG. 23 shows, diagrammatically, a rear view I—I according to FIG. 22 of a first embodiment of a single accelerator member with dovetail connector.
Figure 24:
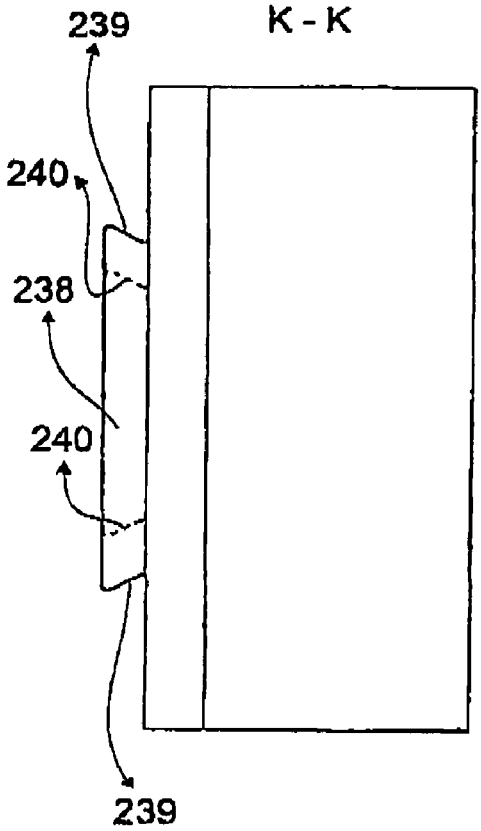
FIG. 24 shows, diagrammatically, a side (longitudinal) view K—K according to FIG. 23 of a first embodiment of a single accelerator member with dovetail connector.

FIGS. 22 to 24 show, diagrammatically, a first embodiment of a single accelerator member (233) provided with an accelerator block (235) and a strengthening member (236), which strengthening member (236) is provided with a fixing member (234) in the form of a protruding part (237) that is provided with a bearing surface (238) that is essentially parallel to the axis of rotation (not shown here), and is provided with a dovetail connector (239) that is oriented transversely to the bearing surface (238) and extends from the bearing surface (238) towards the outer edge of the rotor (not shown here), which dovetail (239) can be made parallel or also widening (240) towards the outside.

Figure 25:
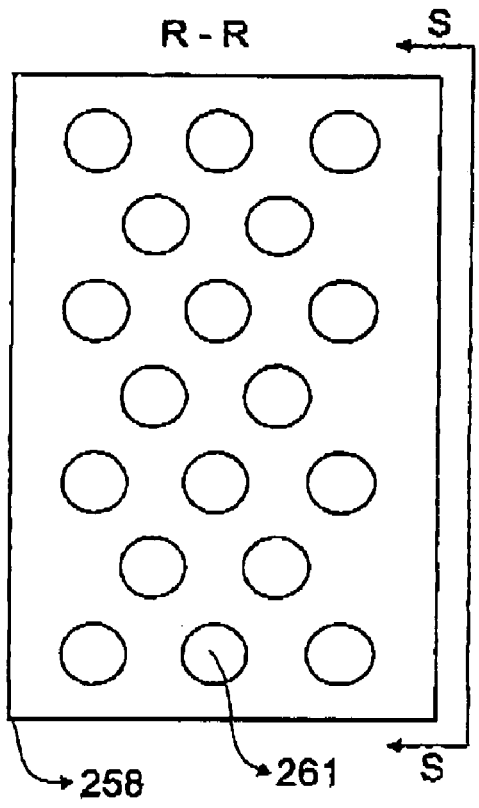
FIG. 25 shows, diagrammatically, a rear view R—R according to FIG. 26 of a first embodiment of a single accelerator member that is provided with a strengthening member with openings.
Figure 26:
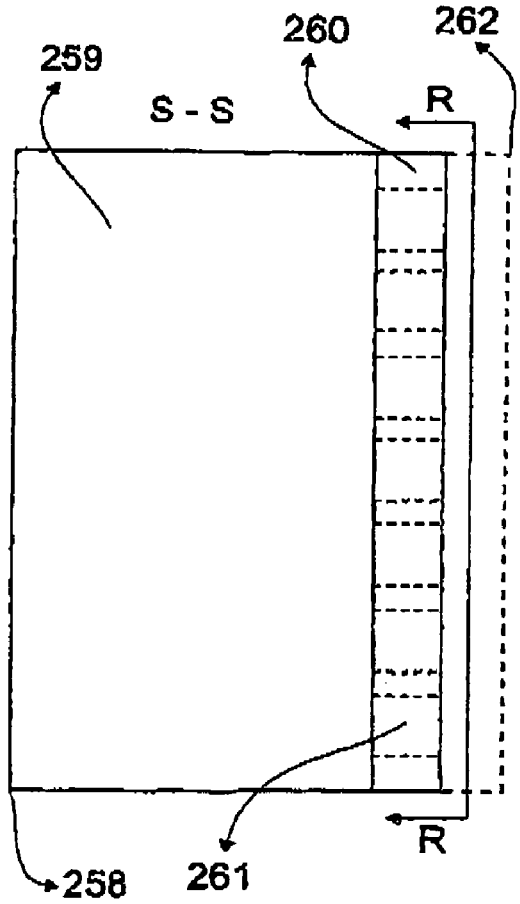
FIG. 26 shows, diagrammatically, a side (longitudinal) view S—S according to FIG. 25 of a first embodiment of a single accelerator member that is provided with a strengthening member with openings.

FIGS. 25 and 26 show diagrammatically, a first embodiment of a single accelerator member (258) that is provided with an accelerator block (259) and a strengthening member (260), which strengthening member (260) is formed by a strengthening plate that is provided with a number of circular openings (261), wherein the accelerator block (259) is cast, in the form of a melt, onto and into this plate, the circular openings (261) filling with the melt (block material). What is achieved by this means is that the strengthening member (260) assumes the temperature of the melt during casting, as a result of which temperature stresses are prevented during cooling and good cohesion between strengthening member (260) and accelerator block (259) is obtained. It is clear that the strengthening member (260) can be provided on the rear with a protruding part or recess as described above. On the other hand, the accelerator block (259) can, of course, also be continued to behind (262) the strengthening member (260).

Figure 27:
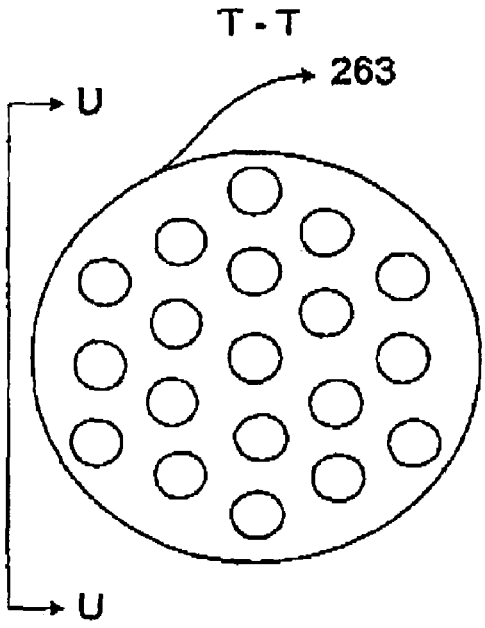
FIG. 27 shows, diagrammatically, a rear view T—T according to FIG. 28 of a second embodiment of a single accelerator member that is provided with a strengthening member with openings.
Figure 28:
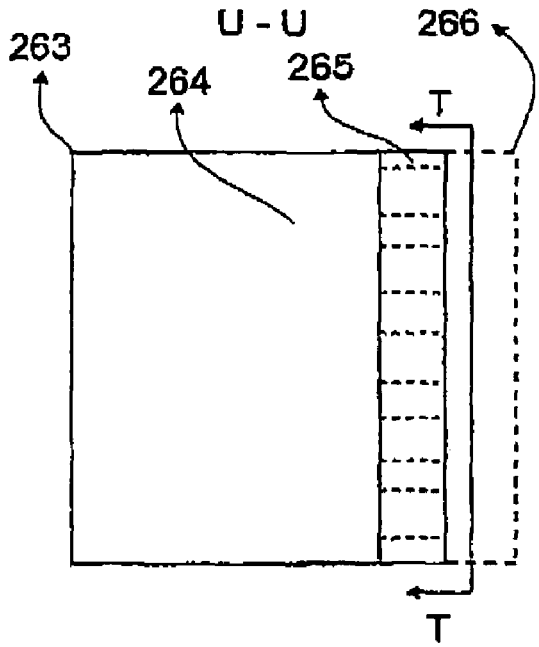
FIG. 28 shows, diagrammatically, a side view U—U according to FIG. 27 of a second embodiment of a single accelerator member that is provided with a strengthening member with openings.

FIGS. 27 and 28 show, diagrammatically, a second embodiment of a single accelerator member (263) that is provided with an accelerator block (264) and a strengthening member (265) essentially identical to the seventeenth single accelerator member (258) from FIGS. 25 and 26, but in this case is made circular, it of course being possible also to make the accelerator member (263) in a different shape and to continue it to behind (266) the strengthening member (265).

Figure 29:
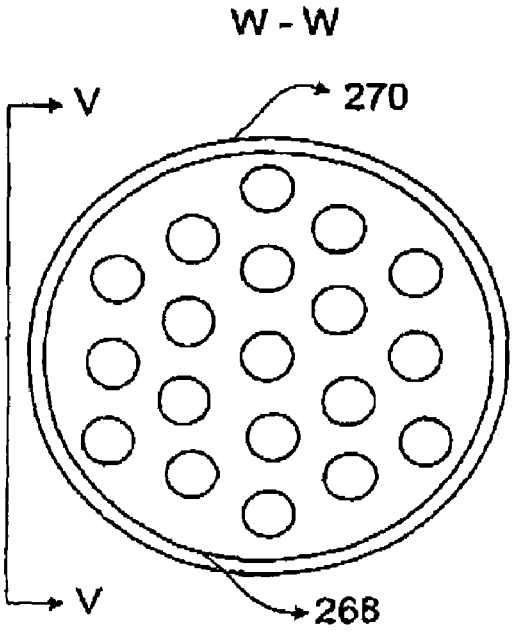
FIG. 29 shows, diagrammatically, a rear view W—W according to FIG. 30 of a third embodiment of a single accelerator member that is provided with a strengthening member with openings.
Figure 30:
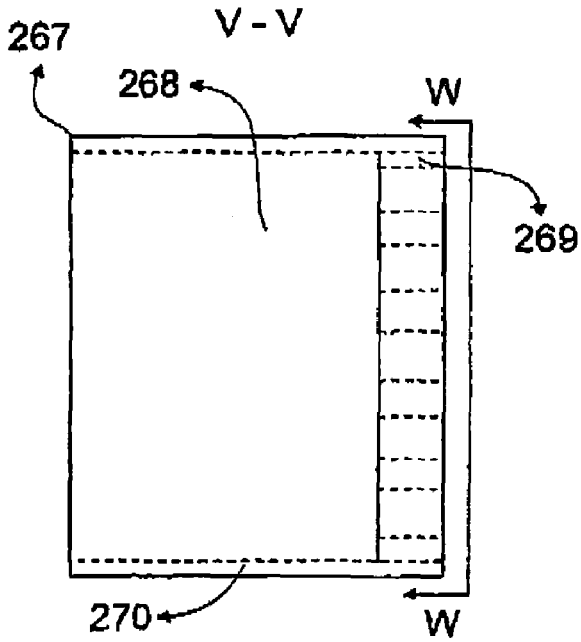
FIG. 30 shows, diagrammatically, a side view V—V according to FIG. 29 of a third embodiment of a single accelerator member that is provided with a strengthening member with openings.

FIGS. 29 and 30 show, diagrammatically, a third embodiment of a single accelerator member (267) provided with an accelerator block (268) and a strengthening member (269) essentially identical to the eighteenth single accelerator member (263) from FIGS. 27 and 28, but here provided with a metal tubular part (270) that extends around the accelerator block (268), by means of which even greater cohesion is obtained.

Figure 31:
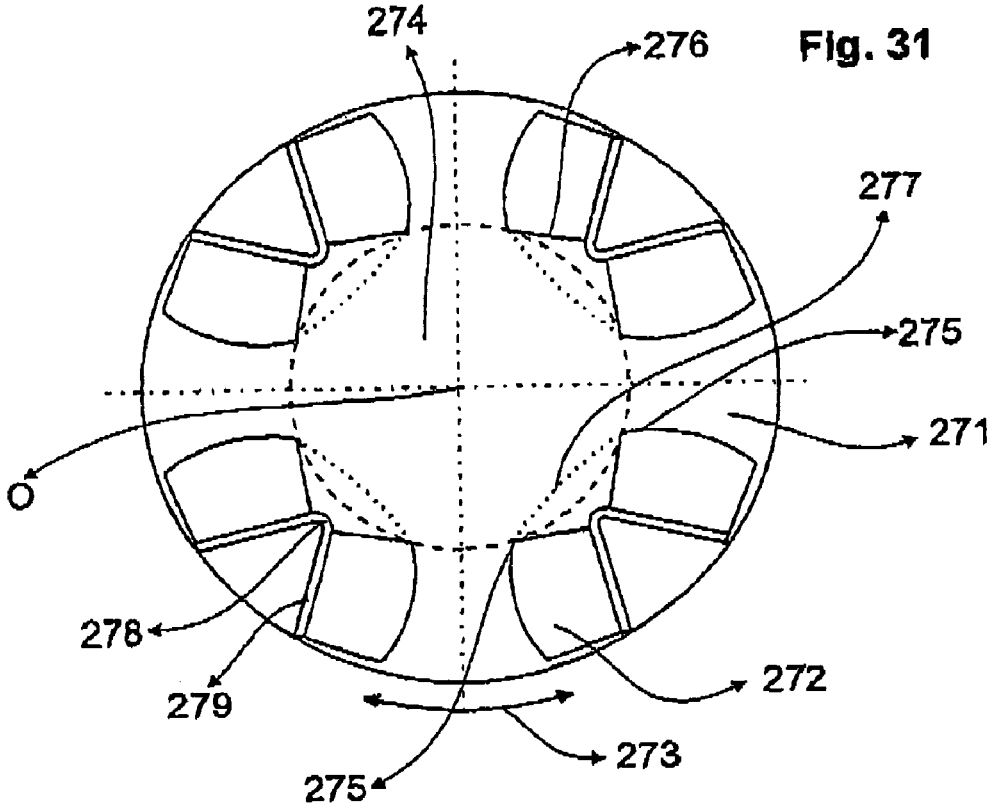
FIG. 31 shows, diagrammatically, a third embodiment of a rotor.

FIG. 31 shows, diagrammatically, a third embodiment of a rotor (271), wherein the accelerator members (272), which here are made V-shaped as a single accelerator member, essentially identical to the first embodiment from FIG. 20, are mounted on the rotor (271), which rotor (271) can be rotated in both directions of rotation (273) about a vertical axis of rotation (O), onto which rotor (271) the material is metered onto a central part (274) at a metering location close to the axis of rotation (O) with the aid of a metering member (not shown here). From the metering location the metered material is fed to the accelerator member (272) and thus is picked up by one of the acceleration surfaces (275) and accelerated along this acceleration surface (275) under the influence of centrifugal force and then propelled outwards from the rotor (271) at high velocity. A bed (277) of own material deposits on the inside (276) of the accelerator member (272), which bed of own material prevents damage being able to occur at the V-shaped point section (278) of the strengthening member (279).

Figure 32:
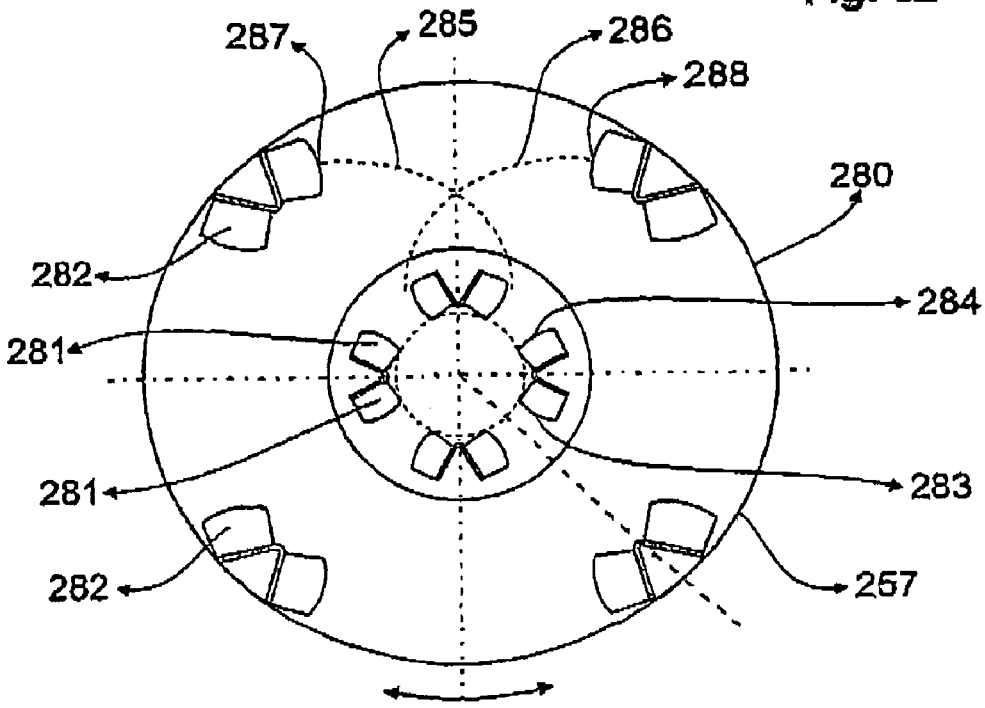
FIG. 32 shows, diagrammatically, a fourth embodiment of a rotor.

FIG. 32 shows, diagrammatically, a fourth embodiment of a rotor (280), where the material is accelerated in two phases with the aid of an accelerator unit which consists of a first accelerator member (281) (that essentially acts as a guide member) for accelerating the material in a first phase and a second accelerator member (282) (that essentially acts as an impact member), associated with the first accelerator member (281), for accelerating the material in a second phase, which first accelerator member (281), which in this case is V-shaped, is provided with two first acceleration surfaces (283)(284) that extend in the direction of the periphery (257) of the rotor (280) for accelerating the metered material with the aid of centrifugal force, after which the material is guided, when it leaves the first accelerator member (281), into a spiral path (285)(286) directed backwards, viewed from a standpoint moving with the first accelerator member (281), the second acceleration surface (287)(288) of which second accelerator member (282), which in this case is V-shaped, being arranged transversely in said spiral path (285)(286) directed backwards, for accelerating the material by striking. The invention provides a possibility for the material to be accelerated with a different type of guide or impact member for the first or the second phase, that is to say a strengthening member is not provided.

Figure 33:
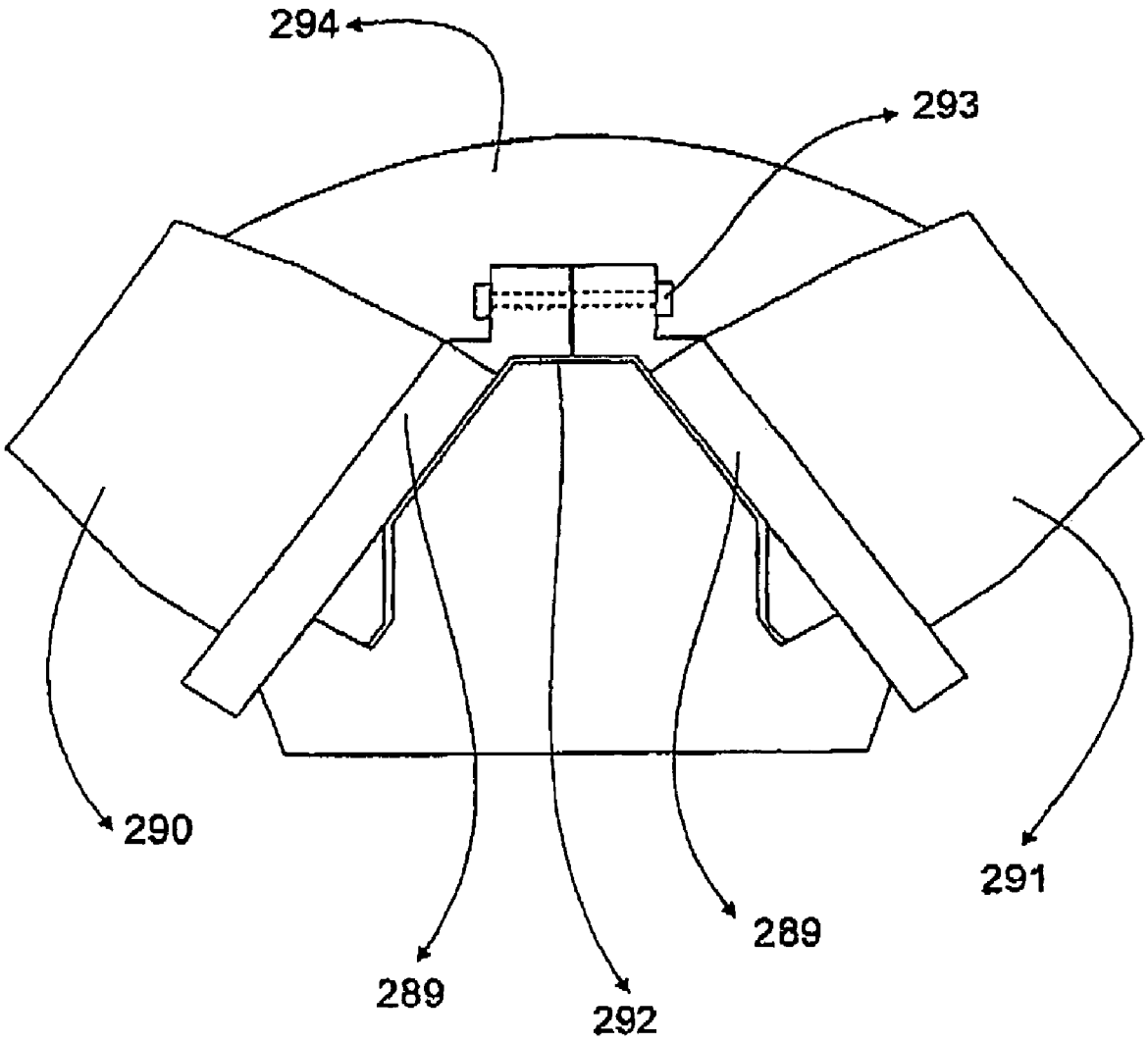
FIG. 33 shows, diagrammatically, a third embodiment of an assembled V-shaped accelerator member.

FIG. 33 shows, diagrammatically, a thirth embodiment of an assembled V-shaped accelerator member (289), wherein two single accelerator members (290)(291) are linked to one another at the truncated V-shaped point (292) to give the assembled accelerator member (289) with the aid of a linking member in the form of at least one bolt (293), which bolt (293) is protected by a layer of own material (294) that deposits between the single accelerator members (290)(291) under the influence of centrifugal force.

Figure 34:
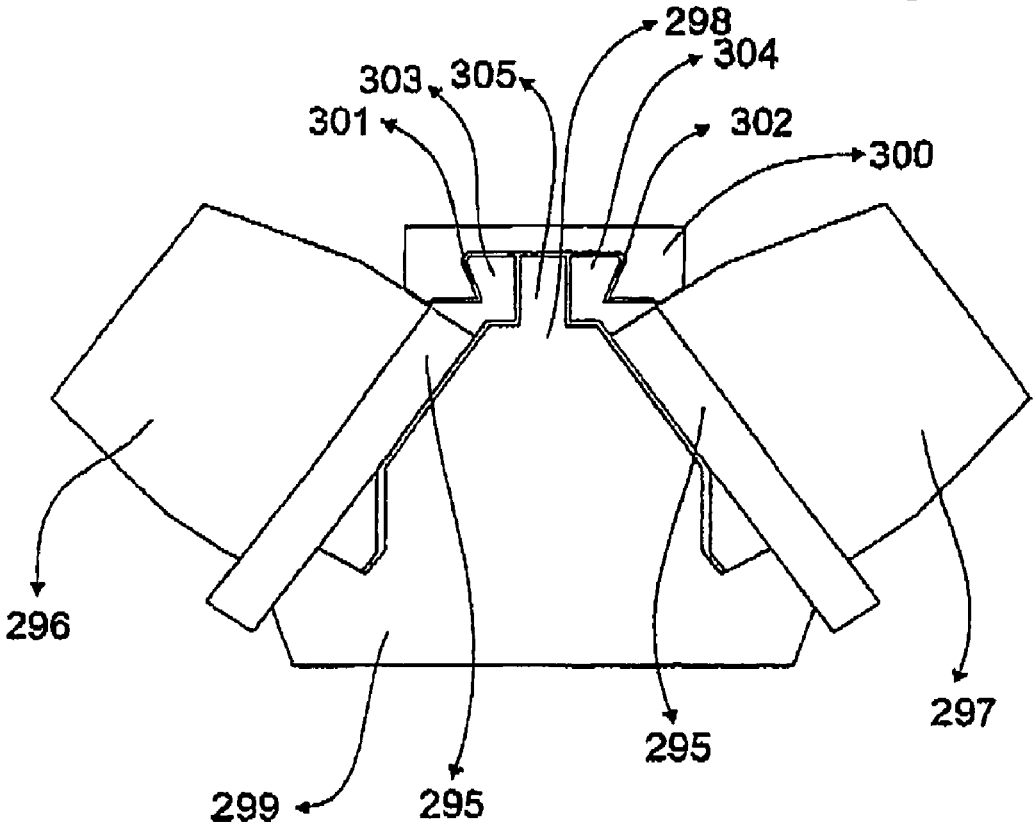
FIG. 34 shows, diagrammatically, a fourth embodiment of an assembled V-shaped accelerator member.

FIG. 34 shows, diagrammatically, a fourth embodiment of an assembled V-shaped accelerator member (295), wherein two single accelerator members (296)(297) are linked to one another at the truncated V-shaped point (298) to give the assembled accelerator member (295) with the aid of the support member (299) and a linking member in the form of a clamping hook (300) that is pushed over the truncated V-shaped point (298), for which purpose each of the single accelerator members (296)(297) is provided with an opening (301)(302) in the protruding edges (303)(304), which edges (303)(304) bear against a protruding edge (305) of the support member (299).

Figure 35:
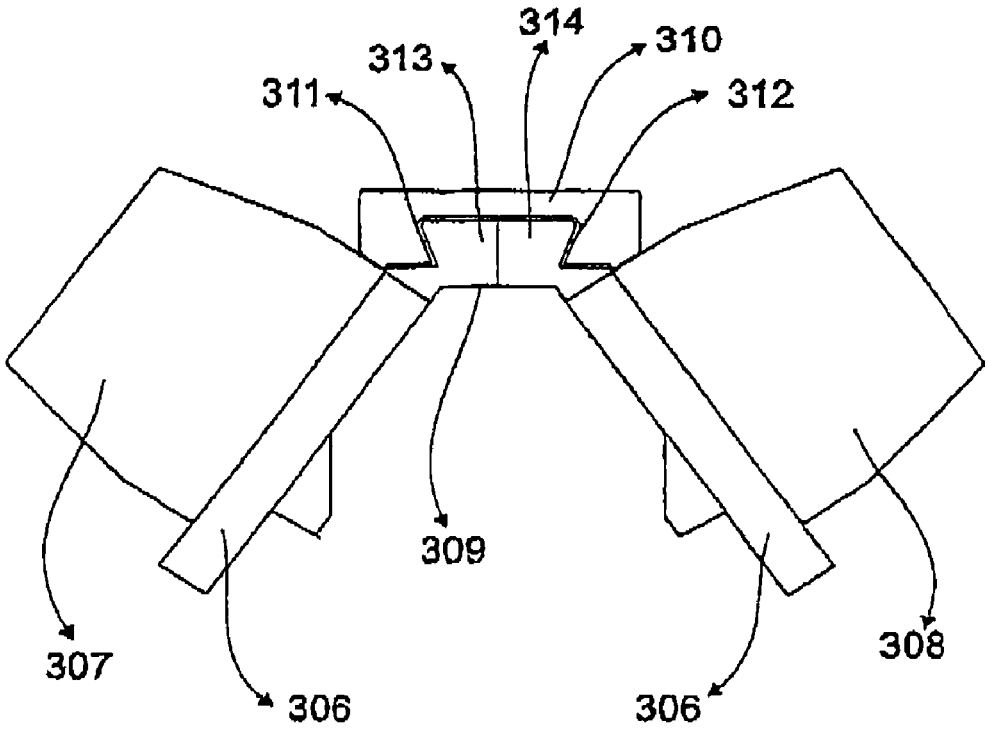
FIG. 35 shows, diagrammatically, a fifth embodiment of an assembled V-shaped accelerator member.

FIG. 35 shows, diagrammatically, a fifth embodiment of an assembled V-shaped accelerator member (306), wherein two single accelerator members (307)(308) are linked to one another at the truncated V-shaped point (309) to give the assembled accelerator member (306) with the aid of a linking member in the form of a clamping hook (310) that is pushed over the truncated V-shaped point (309), for which purpose each of the single accelerator members (307)(308) is provided with an opening (311)(312) in the protruding edges (313)(314), which edges (313)(314) bear against one another.

Figure 36:
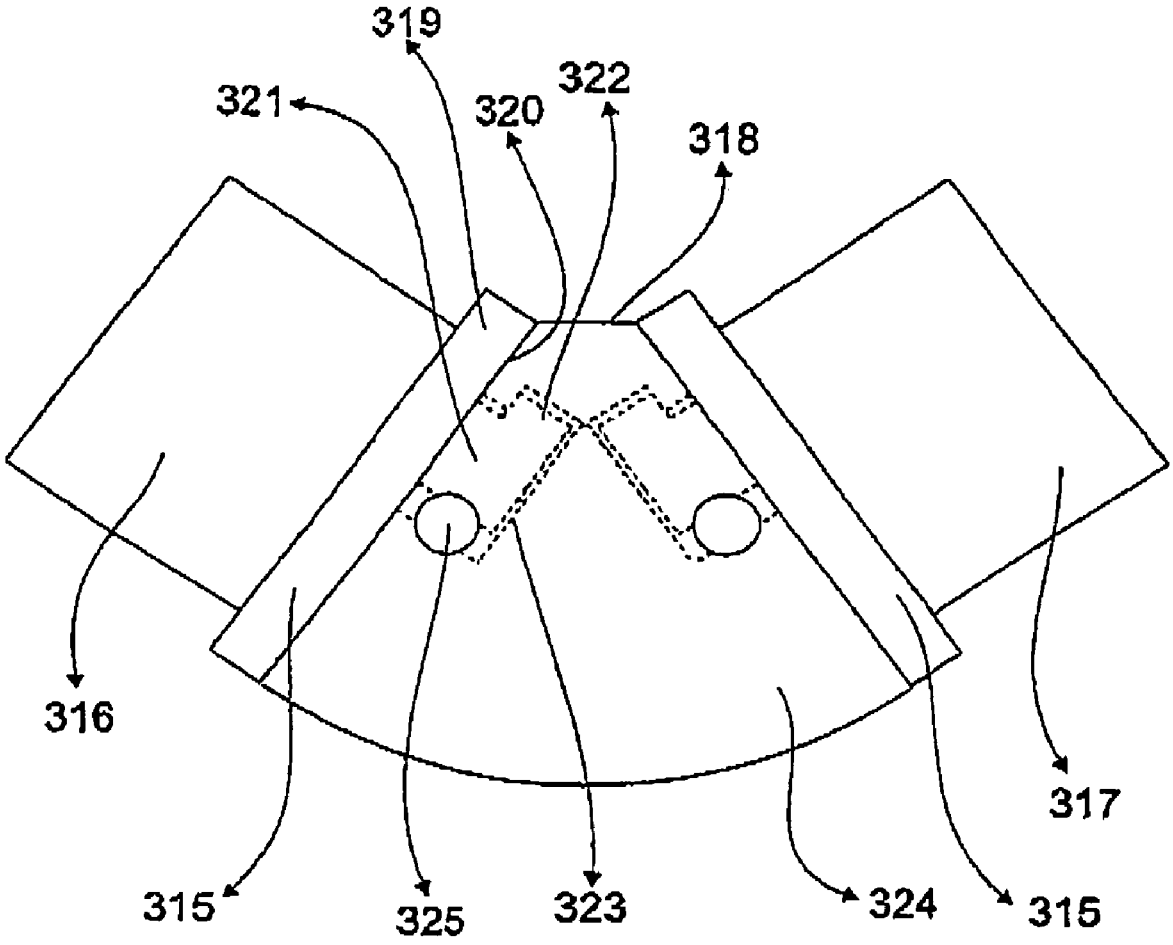
FIG. 36 shows, diagrammatically, a sixth embodiment of an assembled V-shaped accelerator member.

FIG. 36 shows, diagrammatically, a sixth embodiment of an assembled V-shaped accelerator member (315), wherein two single accelerator members (316)(317) are linked to one another at the truncated V-shaped point (318) to give the assembled accelerator member (315), the strengthening member (319) being provided along the back (320) with a projection (321) with a hook (322) that is inserted into an opening (323) in the support member (324) into which the projection (321) and the hook (322) fits and the projection (321) with the hook (322) are secured in the support member (324) with the aid of a locking pin (325).

Figure 37:
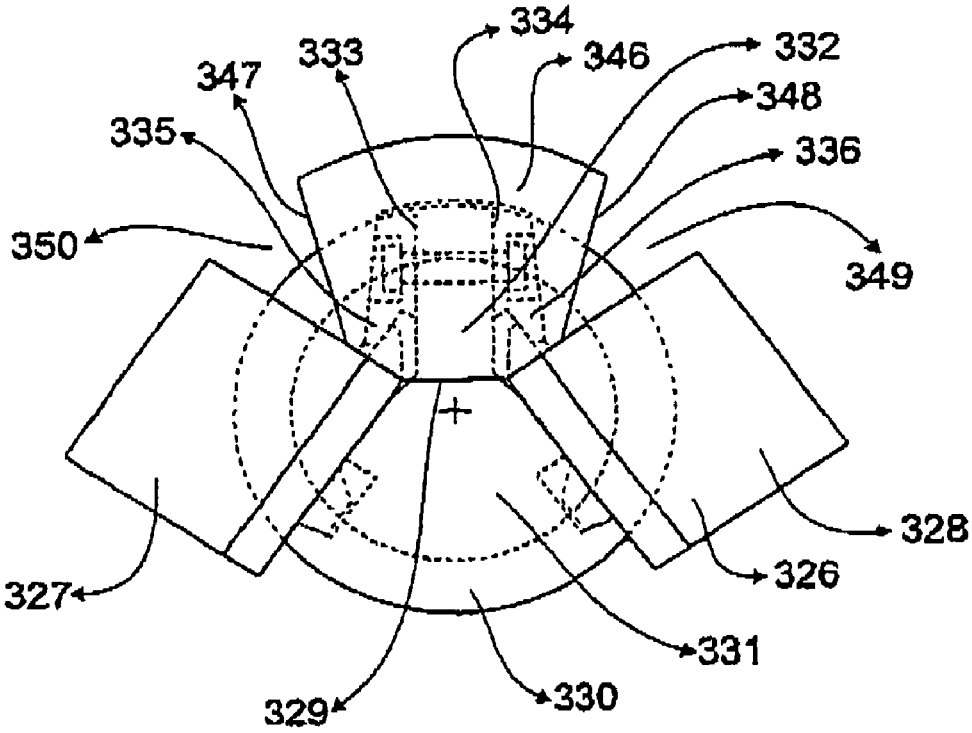
FIGS. 37 and 38 show, diagrammatically, a seventh embodiment of an assembled V-shaped accelerator member.
Figure 38:
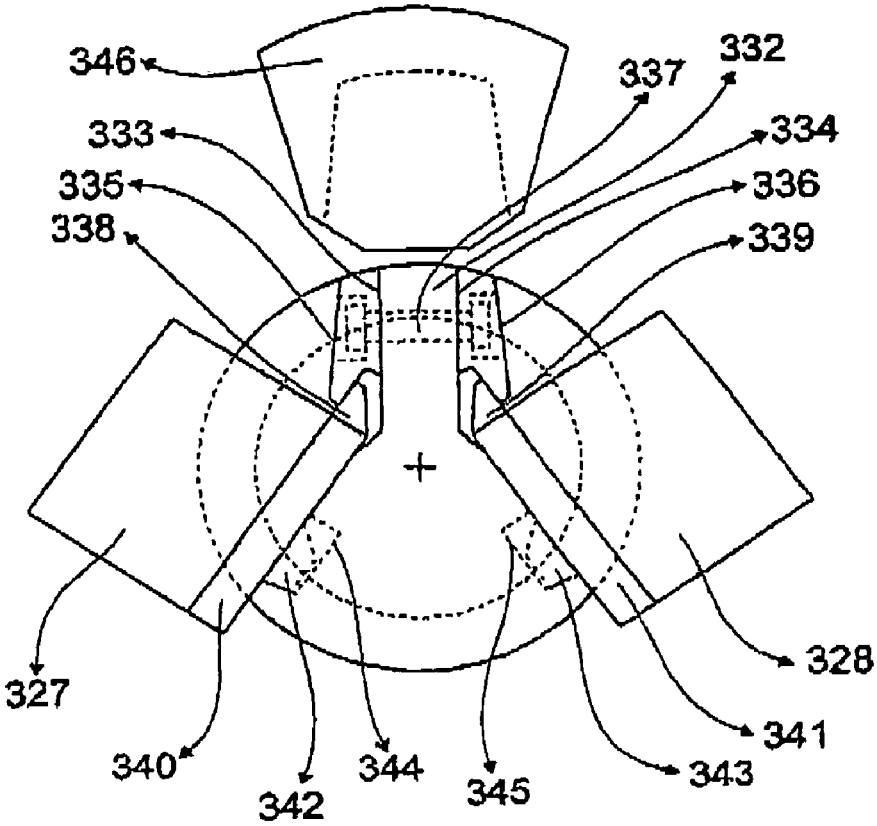

FIGS. 37 and 38 show, diagrammatically, a seventh embodiment of an assembled V-shaped accelerator member (326), wherein two single accelerator members (327)(328)

are linked to one another at the truncated V-shaped point (329) to give the assembled accelerator member (326), wherein the support member (330) is in part constructed in the form of an essentially truncated V-shape (331) and a protruding part (332) that extends from the truncated V (329) parallel in the direction of the axis of rotation, which protruding part (332) is provided on both sides (333)(334) with a hook (335)(336) which hooks (335)(336) are joined to the protruding part (332) with the aid of a bolt (337), in such a way that the single accelerator members (327)(328) fit with a protruding edge (338)(339) of the strengthening member (340)(341) in this hook (335)(336) and, by means of a projection (342)(343) that extends along the back of the strengthening member (340)(341), can be inserted into an opening (344)(345) in the support member (330), in such a way that the single accelerator member (327)(328) anchors itself, with the aid of the projection (342)(343), in this opening (344)(345) in the support member (330) under the influence of centrifugal force. The protruding part (332) with the hooks (335)(336) is protected by a crown member (346) that can be pushed over the protruding part (332) and the hooks (335)(336) and anchors itself against the single accelerator members (327)(328) under the influence of centrifugal force, a V-shaped opening (349)(350) being left on either side (347)(348) between the crown member (346) and the single accelerator member (327)(328), which opening fills with own material.

It is clear that the rotor can be implemented with any other embodiment mentioned here in the invention—and embodiments derived therefrom. The support member can be located behind but also underneath the accelerator member, while many other fixing members also being conceivable according to the invention. The invention provides a possibility for at least one of the plate surfaces to be at least partially parallel to the acceleration surface, and provides a possibility for at least one of the plate surfaces to be at least partially oriented perpendicularly to the acceleration surface.

The above descriptions of specific embodiments of the present invention have been given with a view to illustrative and descriptive purposes. They are not intended to be an exhaustive list or to restrict the invention to the precise forms given, and having due regard for the above explanation, many modifications and variations are, of course, possible. The embodiments have been selected and described in order to describe the principles of the invention and the practical application possibilities thereof in the best possible way in order thus to enable others skilled in the art to make use in an optimum manner of the invention and the diverse embodiments with the various modifications suitable for the specific intended use. The intention is that the scope of the invention is defined by the appended claims according to reading and interpretation in accordance with generally accepted legal principles, such as the principle of equivalents and the revision of components.

The invention claimed is:

1. A rotary accelerator device for accelerating non-uniform material with the aid of centrifugal force in at least a first phase, after which said accelerated material is comminuted, comprising:

a rotor (123) that is able to rotate about an axis of rotation (131) in at least one direction of rotation;

a metering member for metering said material onto said rotor (123); and at least one accelerator unit comprising at least one casted accelerator member (126, 109) made up of an accelerator block (111) joined together with a strengthening member (110) to form a structural strengthened composite, which strengthening member (110) is made of a structural material that has an appreciably greater tensile strength than another structural material from which said accelerator block (111) is made, wherein, a composition of alloys of said strengthening member (110) and said accelerator block (111) are different such that when said casted accelerator member is subject to thermal after treatment, said accelerator block (111) develops a desired hardness and said strengthening member (110) retains a desired tensile strength, which accelerator block (111) along one blockside is provided with an acceleration surface (114) that extends in a direction of a periphery (351) of said rotor (123) for accelerating said metered material, which accelerator member is attached to a support member (137) that is carried by said rotor (123) in such a way that said accelerator member can be dismantled for replacement because of wear, said strengthening member (110) is plate-like and joined with a plate surface or attachment side (120) to an attachment surface (355) that is located opposite of said acceleration surface (114) and extends in the direction of the periphery (351) of said rotor (123), the thickness of which strengthening member (110) is less than one third of the thickness of said accelerator block (111) between said acceleration surface (114) and said attachment surface (355), and which strengthening member (110) is provided with at least one fixing member (112, 113) for fixedly attaching said accelerator member to said support member (137).

2. Accelerator device according to claim 1, wherein, said accelerator block is provided with one strengthening member, a block side of said accelerator block is situated essentially opposite of said acceleration surface and is provided with an attachment surface which describes an essentially straight surface, and at least part of said attachment side of said strengthening member and at least part of said attachment surface of said accelerator block are joined together along an essentially straight attachment plane where said accelerator block is essentially located on one side of a straight dividing plane on which is situated said attachment plane and said strengthening member is essentially located on the other side of said dividing plane.

3. Accelerator device according to claim 1, wherein, said accelerator unit is provided with at least a first accelerator member and a second accelerator member that is associated with said first accelerator member, the accelerator unit is for accelerating said material in two phases, which first accelerator member is provided with at least a first acceleration surface for accelerating said metered material in a first phase, with the aid of guiding along said first acceleration surface, in such a way that said guided material is brought into a spiral path directed backwards, viewed from a standpoint moving with said first accelerator member, which second accelerator member is provided with at least a second acceleration surface that is oriented essentially transversely to said spiral path, the second acceleration surface is for accelerating said guided material in a second phase by striking by said second acceleration surface, various aspects being such that said first acceleration phase takes place a shorter radial distance away from said rotor than said second acceleration phase, which occurs an appreciably greater radial distance away.

4. Accelerator device according to claim 1, wherein, said accelerator unit is provided with at least one guide member and an accelerator member that is associated with said guide member for accelerating said material in two phases, which guide member is provided with at least one guide surface that at least partially extends towards an outer edge of said rotor, for accelerating said metered material in a first phase with the aid of guiding along said guide surface such that said guided material is brought into a spiral path directed backwards viewed from a standpoint moving with said guide member, the acceleration surface of which accelerator member is oriented essentially transversely to said spiral path for accelerating said guided material in a second phase by striking by said acceleration surface, various aspects being such that said first acceleration phase takes place a shorter radial distance away from said rotor than said second acceleration phase, which occurs an appreciably greater radial distance away.

5. Accelerator device according to claim 1, wherein, said accelerator unit is provided with at least one accelerator member and a collision member that is associated with said accelerator member for accelerating said material in two phases, wherein said first phase of the acceleration takes place with the aid of said accelerator member by guiding said metered material along said acceleration surface in such a way that said guided material is brought into a spiral path directed backwards, viewed from a standpoint moving with said accelerator member, a collision surface of which collision member, at least partially extends towards an outer edge of said rotor and is oriented essentially transversely to said spiral path for accelerating said guided material in a second phase by striking by said collision surface, various aspects being such that said first acceleration phase takes place a shorter radial distance away from said rotor than said second acceleration phase, which occurs an appreciably greater radial distance away.

6. Accelerator device according to claim 1, wherein said accelerator block essentially describes a rectangle.

7. Accelerator device according to claim 1, wherein said accelerator member is provided with two identical impact blocks, in such a way that said accelerator member is mirror symmetrical with respect to a radial plane of symmetry from said axis of rotation that intersects said accelerator member halfway between said two accelerator blocks.

8. Accelerator device according to claim 1, wherein said accelerator member is mirror symmetrical with respect to a radial plane of symmetry from said axis of rotation that intersects said accelerator member halfway between two acceleration surfaces.

9. Accelerator device according to claim 8, wherein said mirror symmetrical accelerator member essentially describes a V-shape, a point of the V-shape being oriented towards said axis of rotation.

10. Accelerator device according to claim 9, wherein said essentially V-shaped accelerator member is made up of two individual, but identical, accelerator members which are linked to one another at least with the aid of a linking member.

11. Accelerator device according to claim 9, wherein said essentially V-shaped accelerator member is made up of two individual, but identical, accelerator members which are linked to one another at least with the aid of said support member.

12. Accelerator device according to claim 9, wherein said essentially V-shaped accelerator member is made up of two individual, but identical, accelerator members which are linked to one another at least with the aid of a clamping member.

13. Accelerator device according to claim 1, wherein said strengthening member is mirror symmetrical with respect to a plane of symmetry from said axis of rotation.

14. Accelerator device according to claim 1, wherein said accelerator block is made, at least along an impact surface, of material having a hardness that is the same as or greater than a hardness of the material to be accelerated.

15. Accelerator device according to claim 1, wherein the hardness of said material from which said accelerator block is made is greater than Rc55.

16. Accelerator device according to claim 1, wherein said material from which said accelerator block is made at least partially consists of hard metal.

17. Accelerator device according to claim 1, wherein said material from which said accelerator block is made at least partially consists of ceramic material.

18. Accelerator device according to claim 1, wherein said accelerator member contains at least one cavity along said acceleration surface, in which cavity an autogenous bed of metered material is able to deposit under the influence of centrifugal force.

19. Accelerator device according to claim 1, wherein said strengthening member is made of a metal alloy.

20. Accelerator device according to claim 1, wherein said strengthening member is made of a material that can be welded.

21. Accelerator device according to claim 1, wherein said strengthening member is at least partially made of hard metal.

22. Accelerator device according to claim 1, wherein said strengthening member is at least partially made of hard metal at least along one of the edges.

23. Accelerator device according to claim 1, wherein said accelerator member is mounted on said rotor on hinges.

24. Accelerator device according to claim 1, wherein said accelerator member is constructed with an impact surface that is provided with two impingement surfaces.

25. Accelerator device according to claim 1, wherein said accelerator member is reversible with respect to a plane of rotation.

26. Accelerator device according to claim 1, wherein said accelerator member is reversible in a plane of rotation.

* * * * *